US007114235B2

(12) United States Patent
Jansch et al.

(10) Patent No.: US 7,114,235 B2
(45) Date of Patent: Oct. 3, 2006

(54) AUTOMATED PIPE JOINING SYSTEM AND METHOD

(75) Inventors: Manfred Jansch, Garbsen (DE); Holger Wilschinsky, Seesen (DE)

(73) Assignee: Weatherford/Lamb, Inc., Houston, TX (US)

( * ) Notice: Subject to any disclaimer, the term of this patent is extended or adjusted under 35 U.S.C. 154(b) by 278 days.

(21) Appl. No.: 10/242,303

(22) Filed: Sep. 12, 2002

(65) Prior Publication Data

US 2004/0049905 A1 Mar. 18, 2004

(51) Int. Cl.

| | |
|---|---|
| ***B23Q 3/00*** | (2006.01) |
| ***B21D 39/03*** | (2006.01) |
| ***B23P 21/00*** | (2006.01) |
| ***B23P 19/02*** | (2006.01) |

(52) U.S. Cl. ..... 29/464; 29/429; 29/426.1; 29/709; 29/235

(58) Field of Classification Search ..... 29/464, 29/467, 468, 428, 426.1, 426.5, 407.09, 406, 29/443, 445, 33 T, 700, 709, 235, 237, 240, 29/271, 272, 281.1, 281.5, 282, 281.2; 166/380, 166/77.51, 85.5; 81/57.15, 57.18, 57.2
See application file for complete search history.

(56) References Cited

U.S. PATENT DOCUMENTS

| | | | | |
|---|---|---|---|---|
| 3,021,739 | A | 2/1962 | Grundmann | 81/53 |
| 3,131,586 | A | 5/1964 | Wilson | 81/52.4 |
| 3,302,496 | A | 2/1967 | Mitchell et al. | 81/53 |
| 3,680,412 | A | 8/1972 | Mayer et al. | 81/57.34 |
| 3,722,331 | A | 3/1973 | Radulescu | 81/52.4 |
| 3,796,418 | A | 3/1974 | Carlberg | 269/26 |
| 3,808,916 | A | 5/1974 | Porter et al. | 81/57.19 |
| 4,334,444 | A | 6/1982 | Carstensen et al. | 81/57.18 |
| 4,402,239 | A | 9/1983 | Mooney | 81/57.16 |
| 4,442,892 | A | 4/1984 | Delesandri | 166/85 |
| 4,603,464 | A | 8/1986 | Smith, Jr. et al. | 29/428 |
| 4,649,777 | A | 3/1987 | Buck | 81/57.19 |
| 4,712,284 | A | 12/1987 | Coyle, Sr. et al. | 29/240 |
| 4,811,635 | A | 3/1989 | Falgout, Sr. | 81/57.33 |
| 4,979,356 | A | 12/1990 | Vatne | 81/57.16 |
| 5,000,065 | A | 3/1991 | Haynes | 81/57.2 |
| 5,049,020 | A | 9/1991 | McArthur | 414/22.51 |

(Continued)

FOREIGN PATENT DOCUMENTS

EP 0 339 005 A1 10/1989

(Continued)

OTHER PUBLICATIONS

International Preliminary Examination Report, International Application No. PCT/GB00/04383, dated Feb. 26, 2002.

(Continued)

*Primary Examiner*—John C. Hong
(74) *Attorney, Agent, or Firm*—Patterson & Sheridan, L.L.P.

(57) ABSTRACT

A method and apparatus for making and breaking tubular connections at the surface of a well by utilizing a pipe joining system. The pipe joining system includes a movable support frame for supporting and integrating on a rig floor the tools associated with making and breaking the connection between two tubulars. Tools incorporated in the pipe joining system include combinations of a wrenching assembly for gripping the tubulars and applying torque to the connection, a spinner for spinning the joints of the tubulars into connection, a positioning tool for vertically and/or horizontally aligning the tubulars in the system, a cleaning and doping device for cleaning and doping the threads of the tubulars, a stabbing guide for properly aligning the tubulars before joining, a mud bucket for handling mud spillage during the breaking of the tubulars, and a control system that remotely operates the entire automated system.

34 Claims, 18 Drawing Sheets

U.S. PATENT DOCUMENTS

| | | | | |
|---|---|---|---|---|
| 5,092,399 | A | 3/1992 | Lang | 166/77.5 |
| 5,159,860 | A | 11/1992 | Pietras | 81/57.19 |
| 5,294,228 | A | 3/1994 | Willis et al. | 414/22.55 |
| 6,082,225 | A | 7/2000 | Richardson | 81/57.16 |
| 6,223,629 | B1 | 5/2001 | Bangert | 81/57.15 |
| 6,814,149 | B1 * | 11/2004 | Liess et al. | 166/380 |

FOREIGN PATENT DOCUMENTS

| | | | |
|---|---|---|---|
| GB | 1 215 967 | | 12/1970 |
| GB | 2 049 518 | A | 12/1980 |
| GB | 2 128 526 | A | 5/1984 |
| GB | 2 346 576 | A | 8/2000 |
| GB | 2 346 577 | A | 8/2000 |
| GB | 2 371 509 | | 7/2002 |
| JP | 2000144850 | * | 5/2000 |
| WO | WO 92/18744 | | 10/1992 |
| WO | WO 93/18276 | | 9/1993 |
| WO | WO 95/20471 | | 8/1995 |
| WO | WO 95/25216 | | 9/1995 |
| WO | WO 98/32948 | | 7/1998 |
| WO | WO 00/45026 | | 8/2000 |
| WO | WO 00/45027 | | 8/2000 |
| WO | WO 00/61906 | | 10/2000 |
| WO | WO 01/09479 | | 2/2001 |
| WO | WO 01/38688 | A1 | 5/2001 |
| WO | WO 01/49968 | | 7/2001 |

OTHER PUBLICATIONS

PCT International Search Report, International Application No. PCT/US 03/28653, dated Dec. 19, 2003.

* cited by examiner

AUTOMATED PIPE JOINING SYSTEM AND METHOD

BACKGROUND OF THE INVENTION

1. Field of the Invention

The present invention generally relates to methods and apparatus for making and breaking wellbore tubulars. More particularly, the present invention relates to apparatus and methods for a makeup and breakout system for use on a rig floor that integrates functions including cleaning and doping the threads of the tubular, spinning the connection, wrenching the connection, guiding the stabbing process, and handling mud spillage.

2. Description of the Related Art

Hydrocarbon wells typically begin by drilling a borehole from the earth's surface to a selected depth in order to intersect a hydrocarbon bearing formation. While the depth of a typical borehole reaches several thousand feet, the length of an individual drill pipe is only approximately thirty feet. Therefore, in the construction of oil or gas wells it is usually necessary to assemble long strings of drill pipe. Due to the length of these pipes, sections or stands of pipe are progressively added to the pipe as it is lowered into the well from a drilling platform. In particular, when it is desired to add a section or stand of pipe the string is usually restrained from falling into the well by applying the slips of a spider located in the floor of the drilling platform. The new section or stand of pipe is then moved from a rack to the well center above the spider. The threaded pin of the section or stand of pipe to be connected is then located over the threaded box of the pipe extending from the well and the connection is made up by rotation therebetween. An elevator is connected to the top of the new section or stand and the entire pipe string lifted slightly to enable the slips of the spider to be released. The entire pipe string is then lowered until the top of the section is adjacent the spider whereupon the slips of the spider are re-applied, the elevator disconnected and the process repeated. Removing the drill pipe from the well requires disassembling the long string of drill pipe by the same process as assembly except in reverse order. When breaking the connection between the pipes as they come out of the well, fluid or mud from within the top drill pipe typically spills out. Without a means of containing and collecting the mud, safety risks increase, replacing lost mud raises costs, and environmental issues become present.

Completion and production phases of oil or gas wells require similar connections between other tubulars such as casing, liner, and tubing. In general, the diameter, location, and function of the tubular that is placed in the wellbore determines whether it is known as drill pipe, casing, liner, or tubing. However, the general term tubular or tubing encompasses all of the applications.

It is common practice to use devices designed to aid and automate making up and breaking out the drill pipe. Tools used in this process include devices for cleaning and doping the threads, spinners that quickly rotate the pipes, hydraulic power tongs or wrenches that torque the connection, stabbing guides that align the pipes, and mud buckets that contain mud spillage. Currently, these devices represent substantially non-integrated separate tools with different levels of automation. Therefore, the process of assembling and disassembling drill pipe strings requires manual operation of controls and a high level of physical interaction within close proximity of the tool being used at the well center. This provides both a risk of injury and a higher possibility of incorrect operation of the various devices while making up and breaking out the drill pipe. The monotonous routine of these operations increases the probability of injury and operator error. Therefore, a tool offering remote operation and substantial automation reduces safety risks and increases repeatability due to the limited human interaction that is necessary.

In addition, individual devices used in making up and breaking out drill pipe inefficiently occupy a large amount of space on the drilling platform. These devices must compete for space with tools used in other operations on the platform. Due to limited floor space on drilling platforms, leasing or obtaining additional floor space for the individual devices becomes expensive. Acquiring additional floor space on an off-shore rig floor is especially expensive since this may require obtaining an extra boat with a deck that can be positioned near the platform and used for transferring tools onto and off of the rig floor. Therefore, an integrated tool for making and breaking pipe connections that utilizes a small footprint offers substantial cost savings in the construction of oil and gas wells.

When utilizing independent devices in making up and breaking out drill pipe, a separate mechanism must be used within each device that centers and positions the pipe into proper alignment. This introduces a redundancy in mechanisms used to center and position the drill pipe. Independent and non-integrated devices also lack the ability to utilize one control system. Due to the high costs associated with the construction of oil and gas wells, time is critical, and repeating the drill pipe positioning operations and arranging independent components over the well at the appropriate time increases the time taken to attach each new section or stand of pipe. Positioning independent components around the drill pipe at the appropriate time requires the use of interlocking structures that prevent collisions between the individual tools. Traditionally, individual devices cost more than single integrated devices, especially when the integrated device incorporates common features of the individual devices.

Therefore, there is a need for an improved apparatus for making or breaking a tubular connection. Further, there is a need for an apparatus that will make up or break out a tubular connection that combines and integrates individual tools into one space efficient, safe, precise, remote controlled operation.

SUMMARY OF THE INVENTION

The present invention generally relates to apparatus and methods for joining tubulars at the surface of a well by utilizing a pipe joining system. The pipe joining system includes a movable support frame for supporting and integrating on a rig floor the tools associated with making and breaking the connection between two tubulars. Tools incorporated in the pipe joining system include combinations of a wrenching assembly for gripping the tubulars and applying torque to the connection, a spinner for spinning the joints of the tubulars into connection, a positioning tool for vertically and/or horizontally aligning the tubulars in the system, a cleaning and doping device for cleaning and doping the threads of the tubulars, a stabbing guide for properly aligning the tubulars before joining, a mud bucket for handling mud spillage during the breaking of the tubulars, and a control system that remotely operates the pipe joining system.

In one embodiment of the invention, the pipe joining system is moved on the rig floor to the well center by movement of the support frame along a track, a tubular extending from the wellbore is aligned vertically and/or horizontally in the wrenching assembly by a positioning tool, the wrenching assembly grips the tubular, a cleaning and doping device cleans and dopes the threads of the tubular, a stabbing guide aligns a pin coupling of a second tubular that is vertically suspended above the tubular extending from the wellbore, a spinner spins the tubulars into connection, and the wrenching assembly applies torque to the connection. Another aspect of this embodiment includes positioning a mud bucket around the joint between two tubulars when disconnecting the tubulars.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
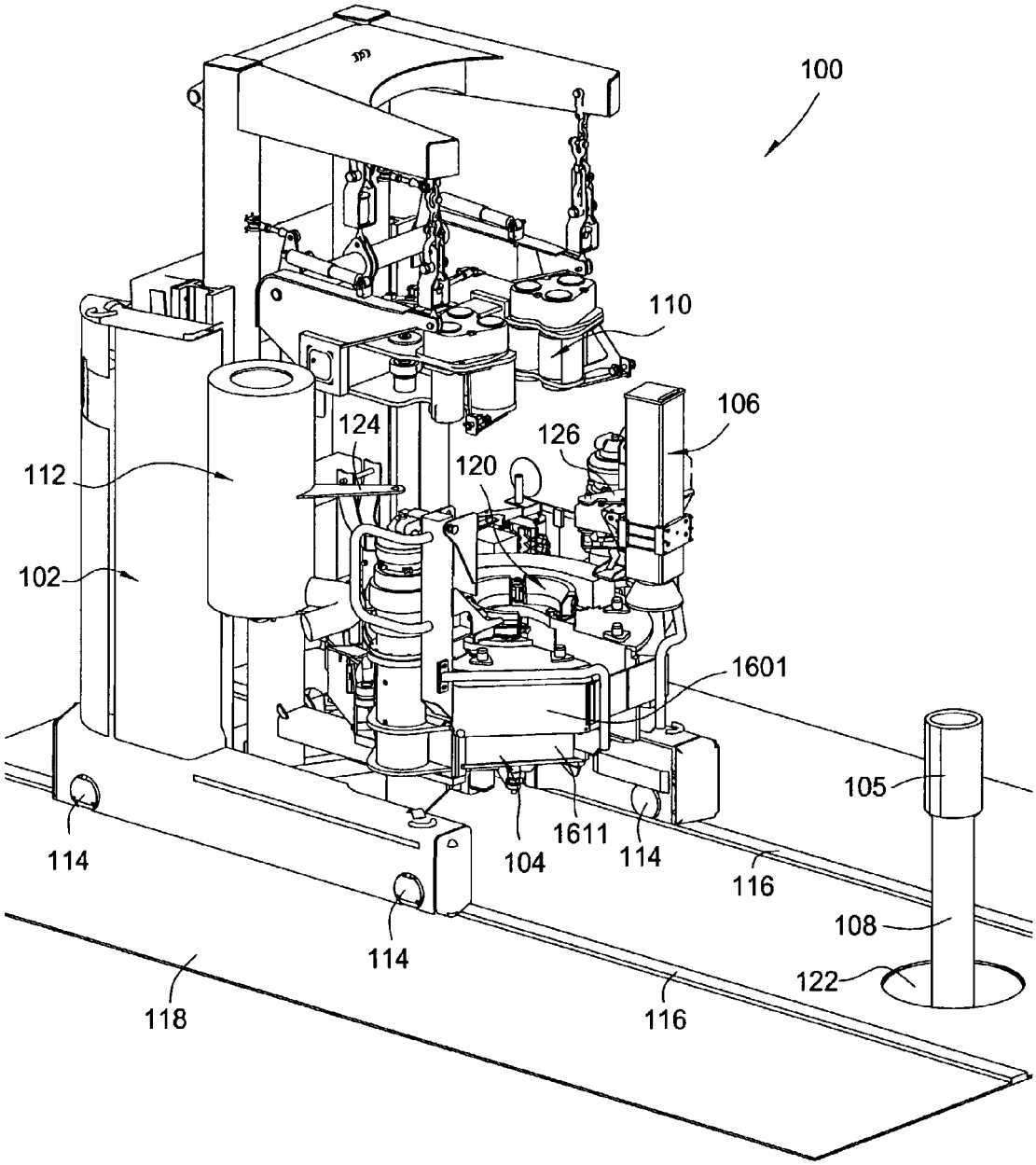
FIG. 1 is a view of an embodiment of the invention in standby position on a rig floor.

The present invention generally relates to apparatus and methods for the joining of tubulars at a surface of a well. FIG. 1 shows an embodiment of a pipe joining system 100 as it would appear in a standby position at the surface of the well. Visible in FIG. 1 is a mobile housing or support structure 102 that supports attached tools including a wrenching assembly 104 with a positioning tool (not visible), a cleaning and doping device 106, a stabbing guide 120 in an open position, a spinner 110, and a mud bucket 112. A single central control system or computer (not shown) that is remotely operated from a safe distance away from the operations at the well center controls and interlocks the function of any or all of these tools. In one embodiment, the control system or computer automates the entire pipe joining system 100. Wheels or rollers 114 located in the base of the support frame 102 allow for movement of the support frame along recesses or tracks 116 in a rig floor 118. In the standby position, the support frame 102 is positioned clear of a tubular 105 that is shown extending through an aperture 122 in the rig floor 118. The bottom portion of the tubular 105 extends into a wellbore that is located directly beneath the aperture 122. While the pipe joining system 100 is in the standby position, other operations can be performed near the well center without the pipe joining system 100 interfering. For example, an elevator (not shown) can raise and lower the tubular 105 and set it in slips of a spider (not shown) while the pipe joining system 100 is in standby position. The mud bucket 112 and cleaning and doping device 106 are shown in their own standby positions relative to the support frame 102. An arm 126 connecting the cleaning and doping device 106 to the support frame 102 and an arm 124 supporting the mud bucket 112 on the support frame 102 position these devices away from the central portion of the pipe joining system 100 while they are in their standby positions.

Figure 2:
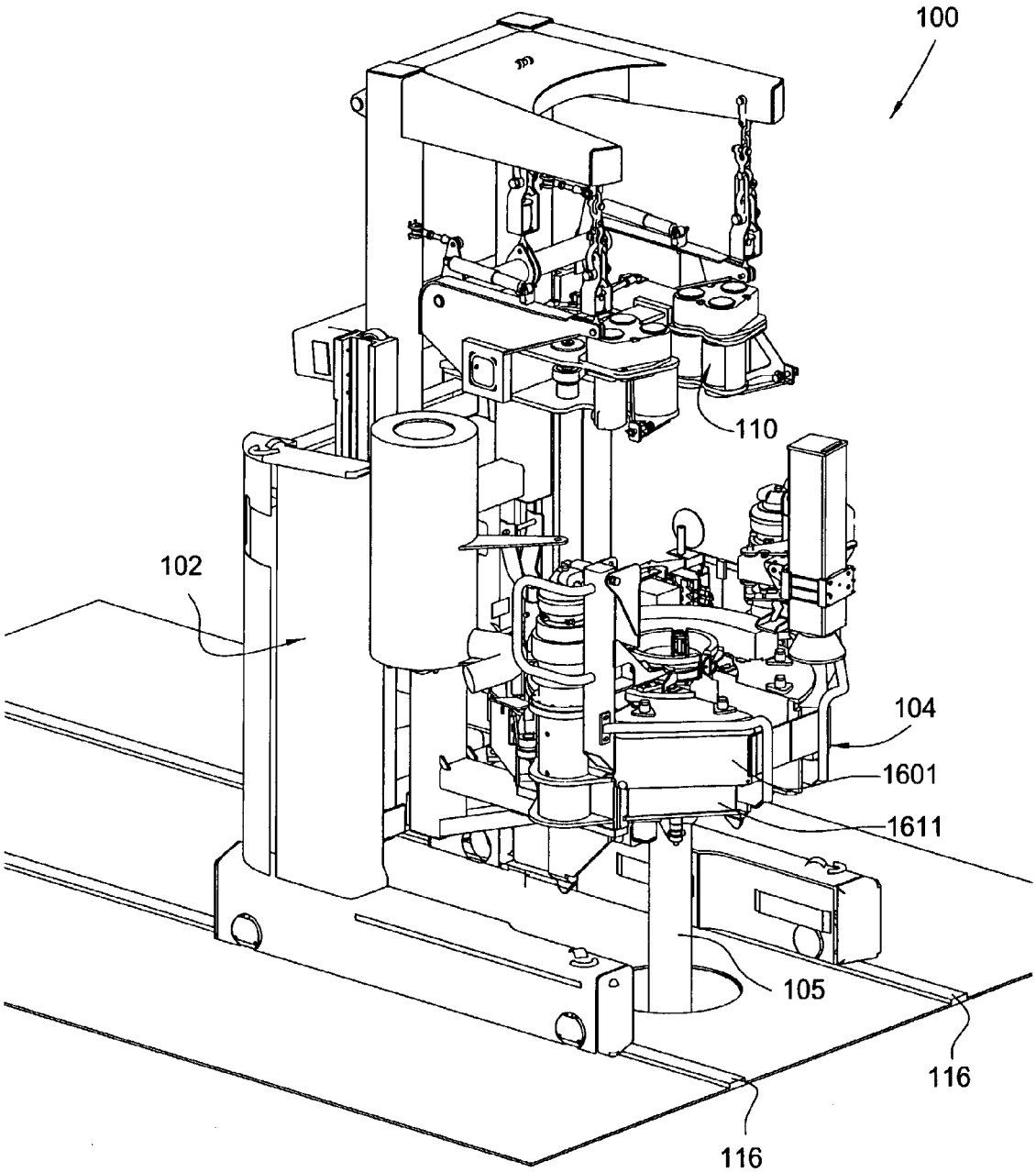
FIG. 2 is a view of an embodiment of the invention in ready position above a well center.

FIG. 2 shows the pipe joining system 100 after it has been moved into a ready position. At a predetermined time, the support frame 102 travels along the tracks 116 until the tubular 105 enters a center portion of the wrenching assembly 104. Preferably, a control system or computer (not shown) controls movement of the pipe joining system 100 to the ready position near the center of the well. Portions of the support frame 102 supporting the spinner 110 and wrenching assembly 104 are shown vertically raised in FIG. 2.

Figure 3:
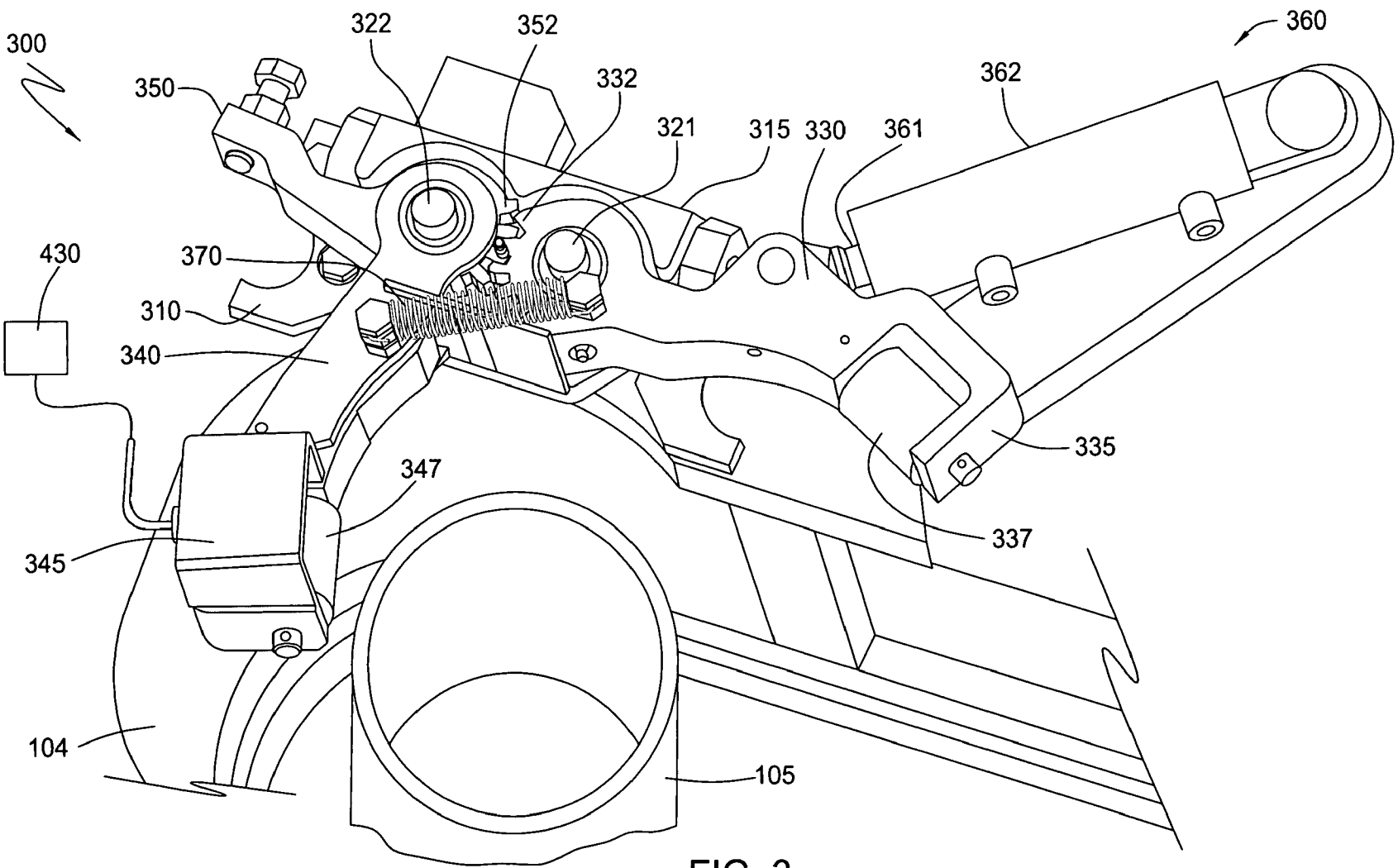
FIG. 3 is a schematic view of an unactuated positioning tool from a perspective below a tong.

FIG. 3 illustrates the positioning tool 300 used to horizontally center tubular 105 in the wrenching assembly 104 after the pipe joining system 100 has been moved to the ready position as shown in FIG. 2. Typically, the positioning tool 300 is mounted onto a lower portion of the wrenching assembly 104. Either movement of the support frame 102 (shown in FIG. 2) or movement via a floating suspension (not shown) that supports the wrenching assembly 104 on the support frame 102 provides the necessary movement required to center the wrenching assembly 104 around the tubular 105. Placing the tubular 105 in the center position reduces the possibility that a gripping apparatus of the wrenching assembly 104 will damage the tubular 105 when the wrenching assembly 104 is actuated. In addition, centering the tubular 105 within the wrenching assembly 104 prevents having to center the other tools of the pipe joining assembly 100 (shown in FIG. 1) with respect to the tubular 105 since they operate in proper alignment with respect to the wrenching assembly 104.

Figure 4:
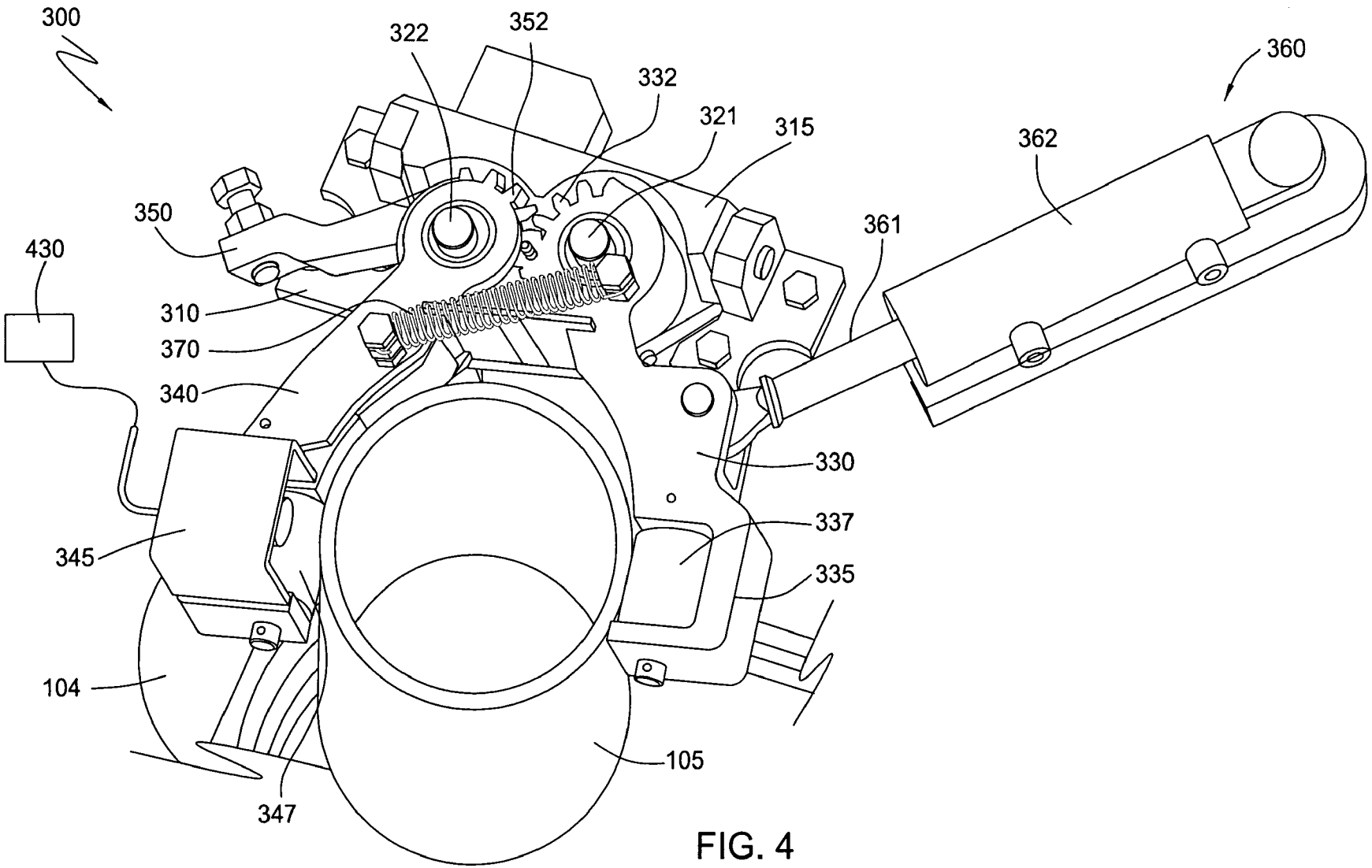
FIG. 4 is a schematic view of the positioning tool of FIG. 3 after the positioning tool has engaged a tubular.

The design of the positioning tool 300 shown in FIG. 3 includes a base 310 for mounting the positioning tool 300 on the wrenching assembly 104. A body portion 315 of the base 310 houses a first axle 321 and a second axle 322. A centering member 330 is movably connected to the first axle 321, and a positioning member 340 and a support member 350 are movably connected to the second axle 322. The positioning tool 300 may further include actuating means 360 (preferably a piston 361 and cylinder assembly 362) for moving the centering member 330 between an open position and a closed position. The proximal end of the centering member 330 has a gear 332 that is coupled to a gear 352 of the support member 350. The gears 332, 352 allow the support member 350 to move in tandem with the centering member 330 when the centering member 330 is moved by the piston 361 and cylinder assembly 362. For example, when the piston 361 and cylinder assembly 362 move the centering member 330 to an unactuated position as illustrated in FIG. 3, the gears 332, 352 will cause the support member 350 to also move to the open position. Upon actuation, the piston 361 extends from the assembly 362, thereby causing the centering member 330 and the support member 350 to rotate toward each other. A housing 335 is disposed at the distal end of the centering member 330 for maintaining at least one gripping means 337. Preferably, the gripping means 337 is a roller so that it may facilitate vertical movement of the tubular 105. The proximal end of the positioning member 340 is movably connected to the second axle 322. A biasing member 370 couples the positioning member 340 to the centering member 330. When the centering member 330 is moved away from the positioning member 340, the tension in the biasing member 370 causes the positioning member 340 to move in a manner that will reduce the tension in the biasing member 370. It must be noted that even though the positioning member 340 is connected to the second axle 322, the positioning member 340, unlike the support member 350, is capable of independent movement from the gears 332, 352. A housing 345 is disposed at the distal end for maintaining at least one gripping means 347. Preferably, the gripping means 347 comprise a roller. In one embodiment, the gripping means 347 of the positioning member 340 is positioned in the path of the tubular 105 as the tubular 105 enters the opening of the wrenching assembly 104. As the wrenching assembly 104 moves toward the tubular 105, the positioning member 340 contacts the tubular 105 and is caused to move to a predetermined position as shown in FIG. 4. In this position, the movement of the wrenching assembly 104 is temporarily stopped and the centering member 330 is moved into contact with the tubular 105. In another embodiment (not shown), the positioning member 340 may be preset at the predetermined position. After the tubular 105 enters the opening and contacts the gripping means 347 of the positioning member 340, the movement of the wrenching assembly 104 is immediately stopped and the centering member 330 moved into contact with the tubular 105. As discussed above, the support member 350 is connected to the second axle 322 and includes a gear 352 coupled to the gear 332 of the centering member 330. Thus, the movement of the support member 350 is controlled by the movement of the centering member 330. The design of the support member 350 is such that it may be moved into engagement with the back of the positioning member 340, thereby allowing the support member 350 to act in concert with the positioning member 340.

Figure 5:
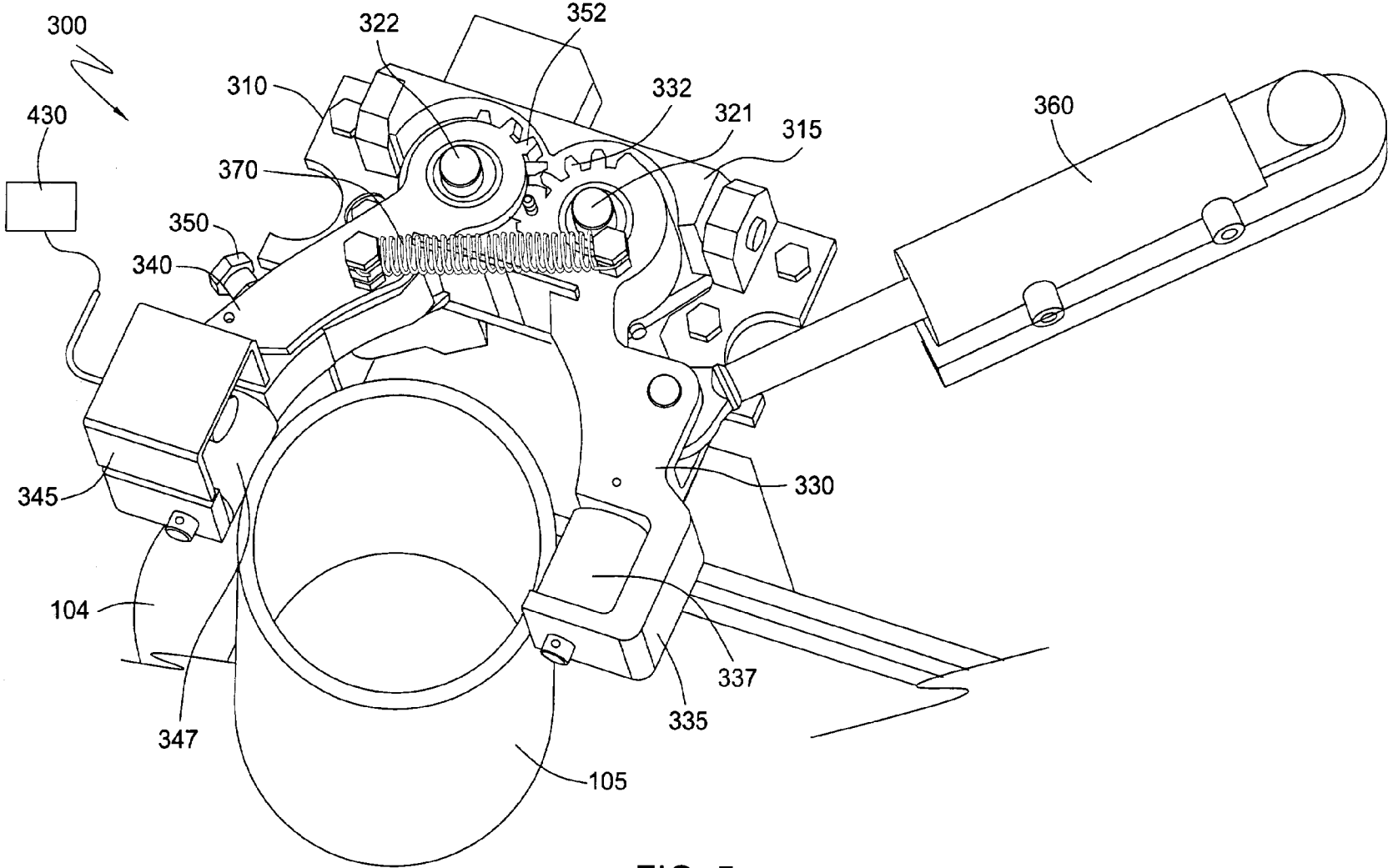
FIG. 5 is a schematic view of the positioning tool of FIG. 4 after the tubular has been centered.

In operation, the centering member 330 and the support member 350 are initially in the unactuated position as illustrated in FIG. 3. The biasing member 370 positions the gripping means 347 of the positioning member 340 in the path of the tubular 105. As the support frame 102 moves to the ready position, the wrenching assembly 104 moves towards the tubular 105 and the roller 347 engages the tubular 105 before the tubular 105 reaches the center of the jaws. Thereafter, the positioning member 340 is moved to the predetermined position as the wrenching assembly 104 continues to move toward the tubular 105 in FIG. 4. As illustrated, the positioning member 340 moves independently of the centering and support members 330, 350. When the predetermined position is reached, the wrenching assembly 104 is stopped and the piston 361 and cylinder assembly 362 are actuated to move the centering member 330 into contact with the tubular 105. FIG. 4 shows the positioning member 340 in the predetermined position and the centering member 330 in contact with the tubular 105. Because the tubular 105 is not centered, the centering member 330 contacts the tubular 105 prematurely. As a result, the centering member 330 has not rotated the gears 332, 352 sufficiently to cause the support member 350 to engage the positioning member 340. This is indicated by the gap that exists between the support member 350 and the positioning member 340. Therefore, the wrenching assembly 104 is moved closer to the tubular 105 in order to allow the centering member 330 and the support member 350 to rotate towards each other, thereby closing the gap between the positioning member 340 and the support member 350. The tubular 105 is centered when the gap closes and the support member 350 engages the positioning member 340 as illustrated in FIG. 5. In this manner, the tubular 105 may be effectively and efficiently centered in the jaws of the wrenching assembly 104.

Figure 6:
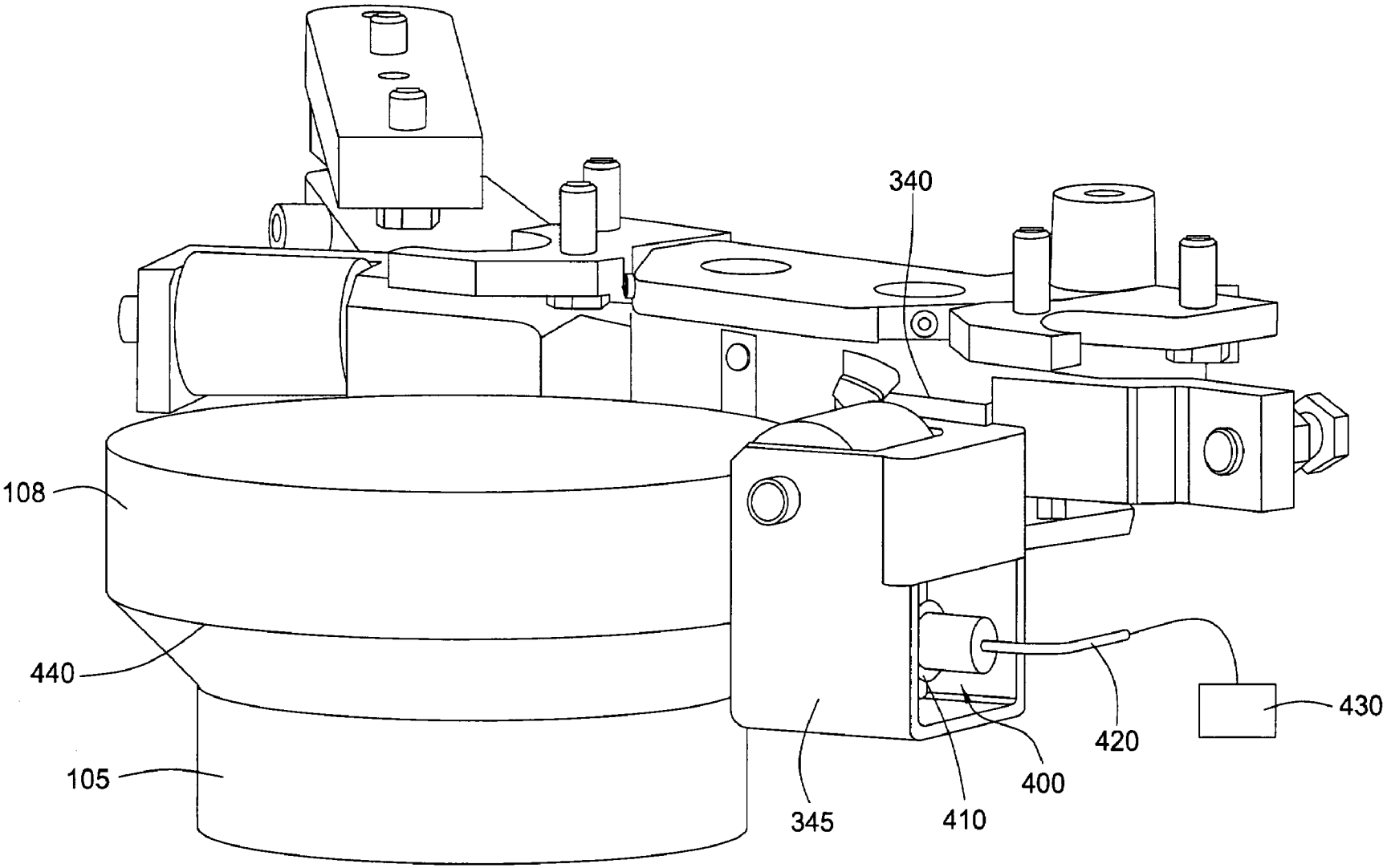
FIG. 6 is a schematic view of the positioning tool contacting a joint of the tubular.

FIG. 6 illustrates another aspect of the positioning tool 300 further including a joint detection member 400 that detects an axial position of a tubular joint 108 for vertical positioning of the tubular 105 within the wrenching assembly 104 (shown in FIG. 2). Generally, after the tubular 105 has been centered, the position of the tubular joint 108 must be determined to ensure that the wrenching assembly 104 grips the tubular joint 108. Typically, a tubular joint 108 has an outer diameter that is larger than an outer diameter of a tubular body 105. Thus, it is preferable for the wrenching assembly 104 to grip the tubular joint 108 during makeup or breakup to minimize damage to the tubular 105. A proximity sensor 410 may be at least partially disposed in the housing 345 of the positioning member 340. The proximity sensor 410 is capable of detecting the relative distance of the tubular 105 from the sensor 410. The proximity sensor 410 may include a wire 420 to connect the proximity sensor 410 to a computer or other programmable device 430 known to a person of ordinary skill in the art. The positioning tool 300 may be preprogrammed with information regarding the tubular 105. The information may include the length of the tubular joint 108 and the outer diameters of the tubular 105 and the tubular joint 108. When the centering and positioning members 330, 340 are in contact with the tubular joint 108, the housing 345 remains in a normal position as shown in FIG. 6. In this position, the proximity sensor 410 may detect the relative distance to the tubular joint 108.

Figure 7:
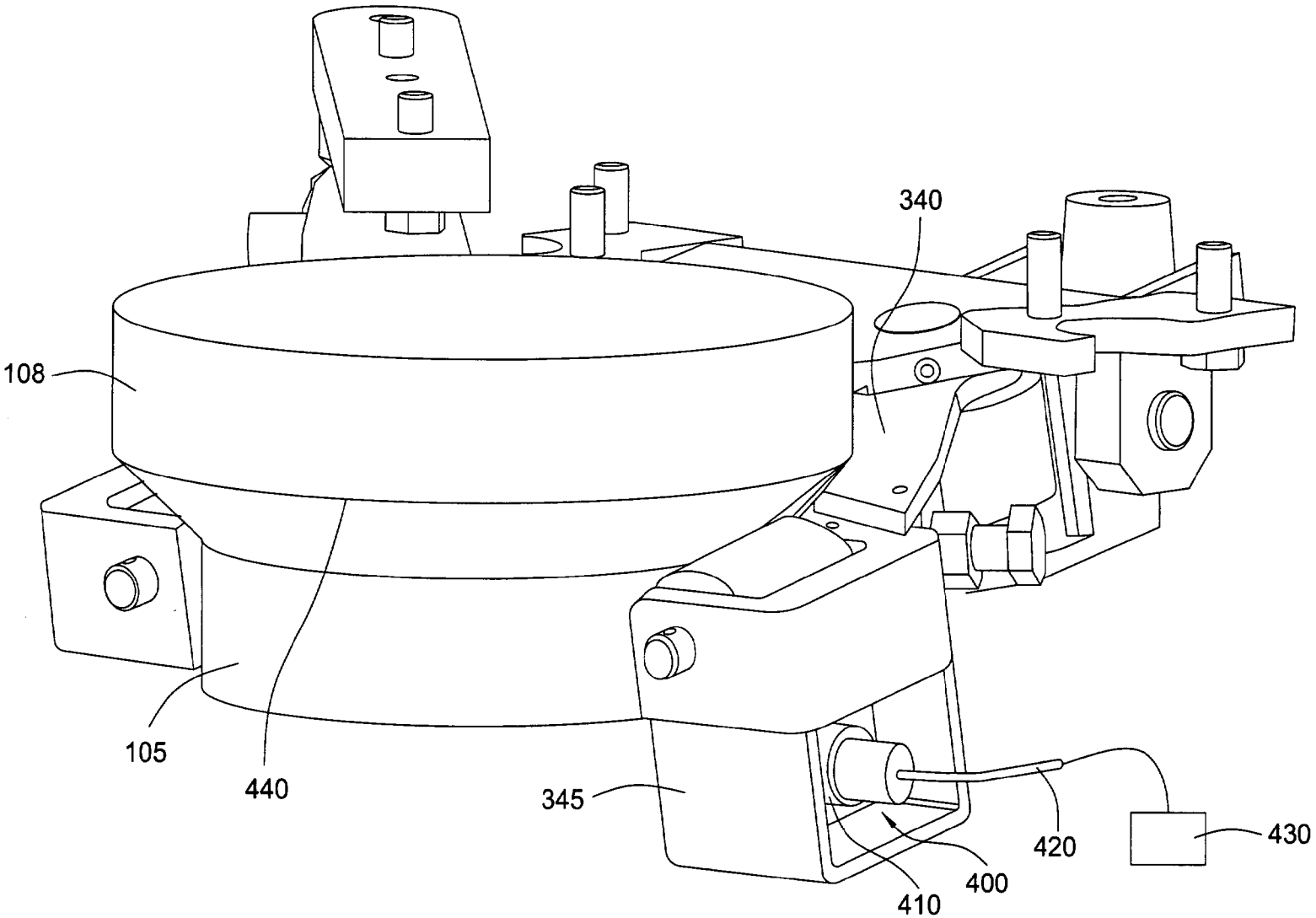
FIG. 7 is a schematic view of the positioning tool contacting a body of the tubular.

However, when the members 330, 340 are centered around the tubular body 105 as illustrated in FIG. 7, the programming allows the positioning tool 300 to recognize that the members 330, 340 are incorrectly positioned. As a result, the housing 345 and the proximity sensor 410 are tilted away from the tubular 105. When this occurs, the wrenching assembly 104 is moved vertically relative to the tubular 105 until the members 330, 340 are centered around the tubular joint 108. Moreover, the proximity sensor 410 may be used to detect the interface 440 between the tubular joint 108 and the tubular body 105. The detected interface 440 is then used as a reference point for positioning the tubular joint 108 relative to the wrenching assembly 104, thereby allowing the jaws to grip the tubular joint 108.

In this manner, the tubular 105 may be properly positioned both vertically and horizontally in the wrenching assembly 104 shown in FIG. 2. Once the tubular is centered in the wrenching assembly 104 (shown in FIG. 2), a back-up tong 1611 on the wrenching assembly 104 firmly grips the tubular 105 in order to maintain the tubular's position throughout the rest of the make up process.

Figure 8:
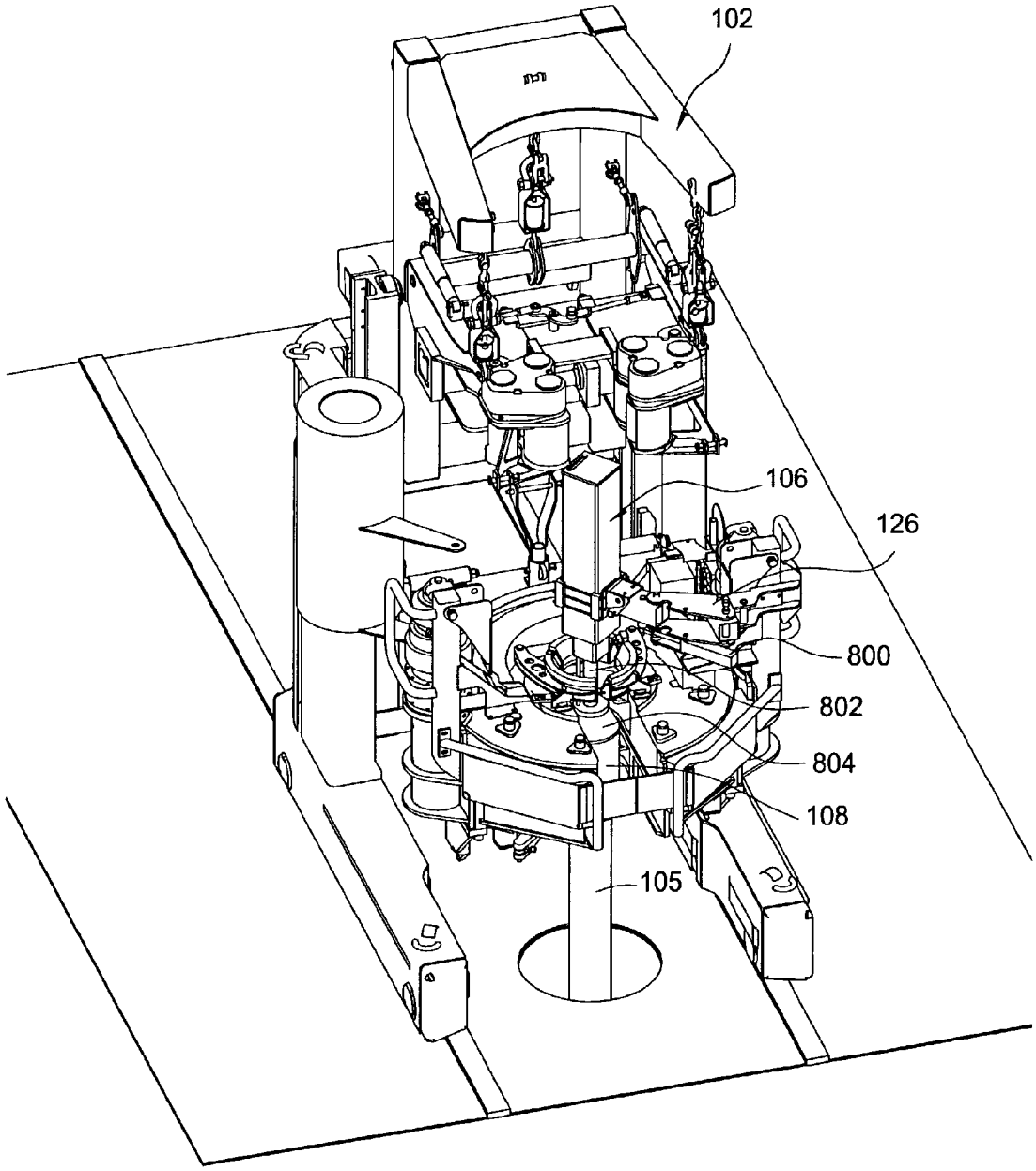
FIG. 8 is a view of a doping and cleaning tool positioned in alignment above a box coupling of the tubular.

FIG. 8 shows the cleaning and doping device 106 positioned directly above the tubular 105. The arm 126 that attaches the cleaning and doping device 106 to the support frame 102 moves the cleaning and doping device 106 from the standby position to a center position over the tubular 105. Since the tubular 105 is centered in the wrenching assembly 104 and the cleaning and doping device 106 in the center position is aligned with respect to the wrenching assembly 104, no further alignment of the cleaning and doping device 106 with respect to the tubular 105 is necessary. An actuating means 800 provides the force necessary to move the arm 126 and the attached cleaning and doping device 106 from the standby position to the center position. Preferably the actuating means 800 is a piston and cylinder assembly. Either an electric motor or hydraulic pressure (not shown) vertically extends a telescoping extendable member 802 from a lower portion of the cleaning and doping device 106 until a cone shaped circumferential shroud 804 at a lower portion of extendable member 802 contacts the top of the tubular 105. The large outside diameter of the shroud 804 accommodates a variety of different sized tubulars 105.

Figure 9:
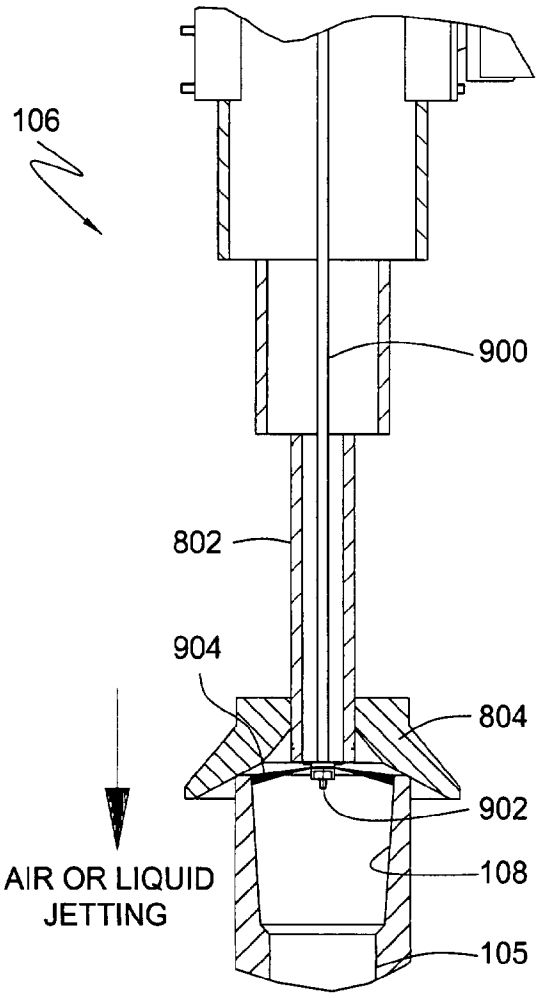
FIG. 9 is a section view of the doping and cleaning tool as an extendable member enters the box coupling and cleans the threads.

FIG. 9 shows the extendable member 802 extending from an upper portion of the tubular joint 108 (shown as a box coupling) to a lower portion of the box coupling 108. The design of the shroud 804 permits a portion of the telescoping extendable member 802 to vertically move through an aperture in the center of the shroud 804. As the extendable member 802 passes downward through the shroud 804, a nozzle 902 discharges an air jet or cleaning fluid 904 inside the box coupling 108. The design of the nozzle 902 sprays a 360-degree area inside the box coupling 108 in order to remove debris from the threads. A channel 900 through the extendable member 802 provides a flow path for the air or cleaning fluid 904 to travel from the body of the cleaning and doping device 106 to the nozzle 902. The shroud 804 prevents the high-pressure air or cleaning fluid 904 discharged through the nozzle 902 from escaping the inside area of the tubular 105.

Figure 10:
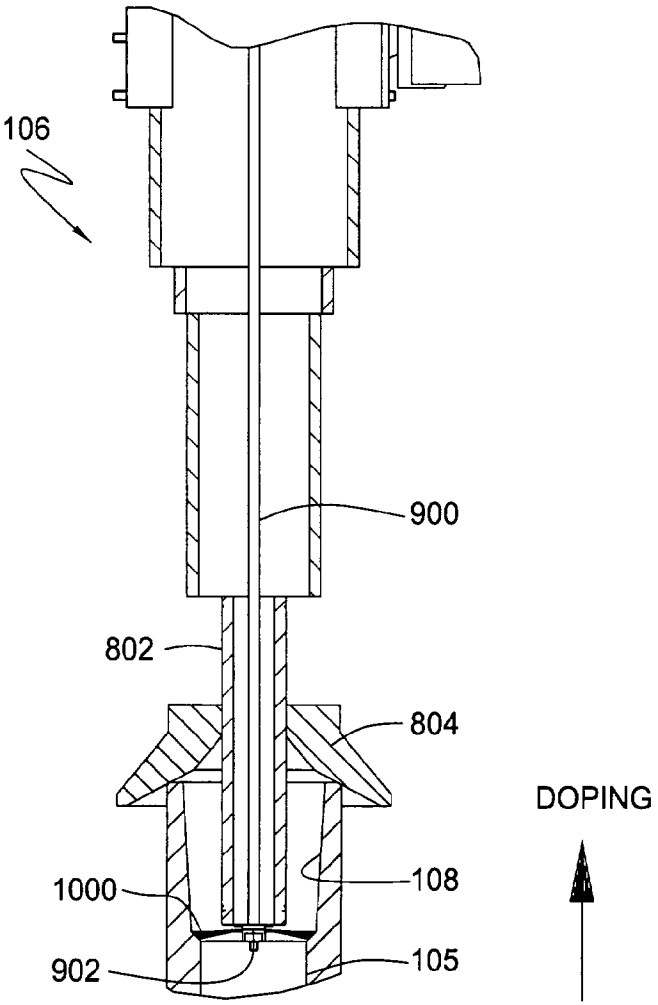
FIG. 10 is a section view of the doping and cleaning tool as the extendable member retracts and dopes the threads of the box coupling.

FIG. 10 illustrates the extendable member 802 retracting from a lower portion of the box coupling 108 to an upper portion of the box coupling 108 while the shroud 804 maintains contact with the top of the tubular 105. During this range of motion, the nozzle 902 discharges a dope or grease 1000 supplied through channel 900 or a second flow pathway (not shown). The dope or grease 1000 applied to the threads (not shown) prevents damage to the threads and aids in forming a fluid tight connection when a second tubular is joined. Upon completing the doping process, the cleaning and doping device 106 is returned to its standby position. One skilled in the art could envision a cleaning and doping device 106 designed to clean and dope threads on a pin coupling instead of the box coupling 108 shown. In addition, a similar device could be utilized to prepare the threads of the next tubular to be added to the tubular string.

Figure 11:
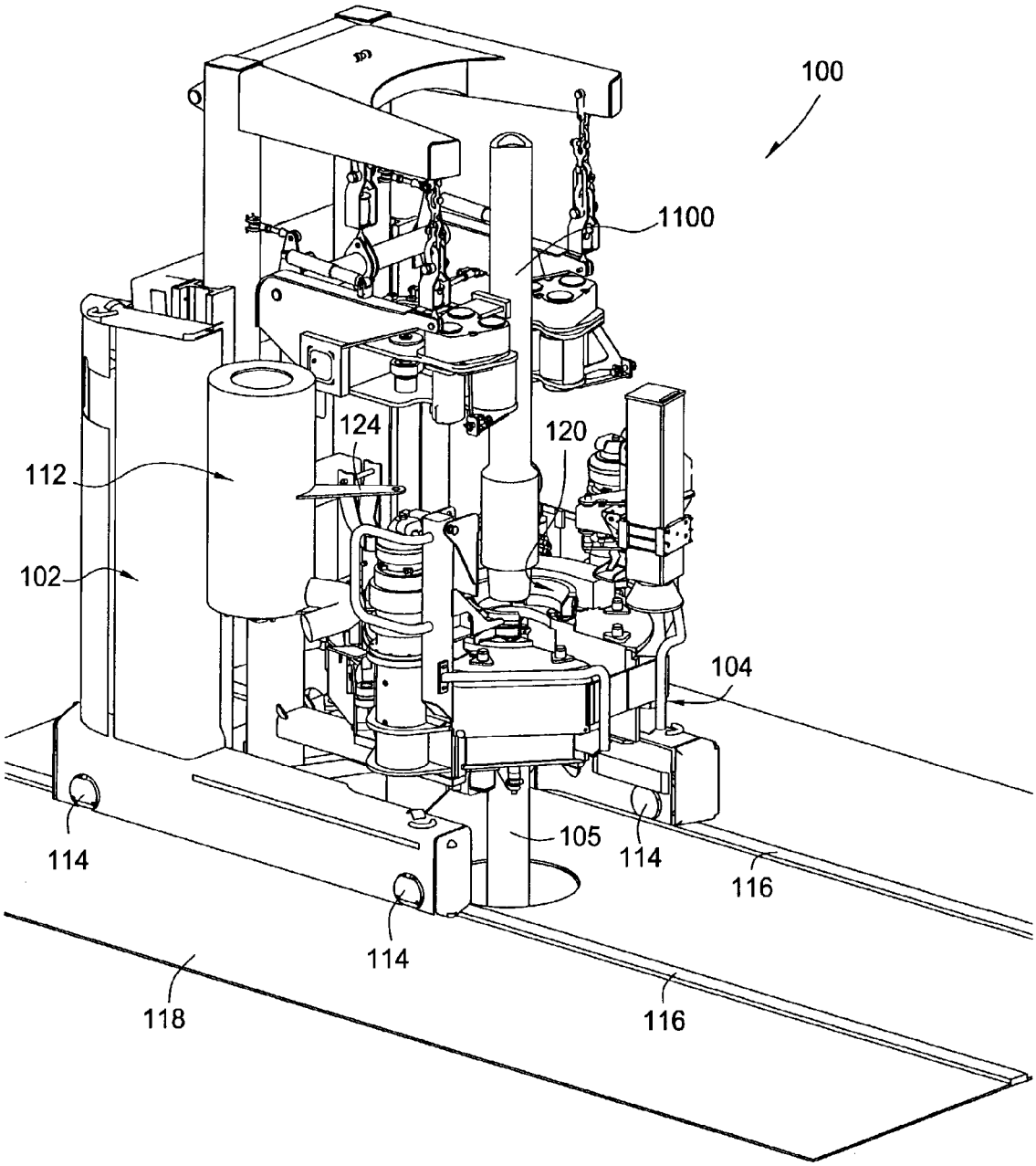
FIG. 11 is a view of an embodiment of the invention with a next strand of tubular positioned above the tubular in the well.

FIG. 11 shows a second tubular 1100 positioned above the tubular 105 and inside the stabbing guide 120. Commonly known procedures such as utilizing an elevator (not shown) places the second tubular 1100 vertically in line with an axis of the first tubular 105. The stabbing guide 120 remains in the open position as the second tubular 1100 is positioned above the tubular 105 and near the center of the stabbing guide 120. Preferably, the stabbing guide 120 is positioned above the wrenching assembly 104 and close to the box coupling 108 of tubular 105. Since the tubular 105 is centered in the wrenching assembly 104 and the stabbing guide 120 is centered with respect to the wrenching assembly 104, no further alignment of the stabbing guide 120 with respect to the tubular 105 is necessary.

Figure 12:
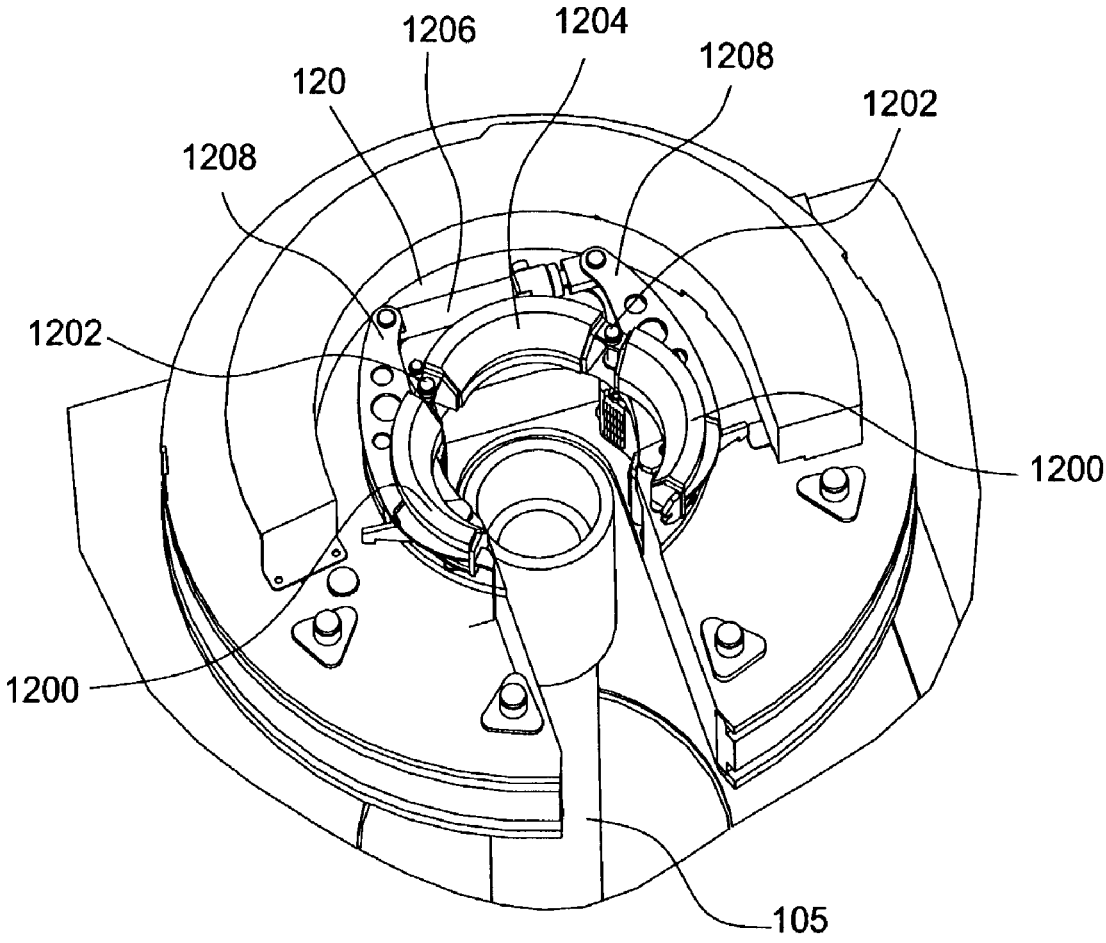
FIG. 12 is a schematic view of a stabbing guide in an open position.

FIG. 12 illustrates the stabbing guide 120 in the open position. The stabbing guide 120 comprises two movable semi-circular segments 1200 connected by two hinges 1202 to the ends of a stationary middle semi-circular segment 1204 and an actuating means 1206. Two arms 1208 attach the actuating means 1206 to the two semi-circular segments 1200. Preferably the actuating means 1206 is a piston and cylinder assembly. The semi-circular segments 1200 and 1204 possess inner surfaces that taper downwardly from a larger diameter to a smaller diameter. The taper aids in guiding a second tubular (not shown) that is initially positioned above the stabbing guide 120 instead of within the center portion of the stabbing guide. In the open position, the actuating means 1206 maintains the outwardly extended position of the two semi-circular segments 1200. Therefore, a gap larger than the outer diameter of a second tubular (not shown) between the two semi-circular segments 1200 allows the tubular 1100 to be positioned above tubular 105 and within the center portion of the stabbing guide 120.

Figure 13:
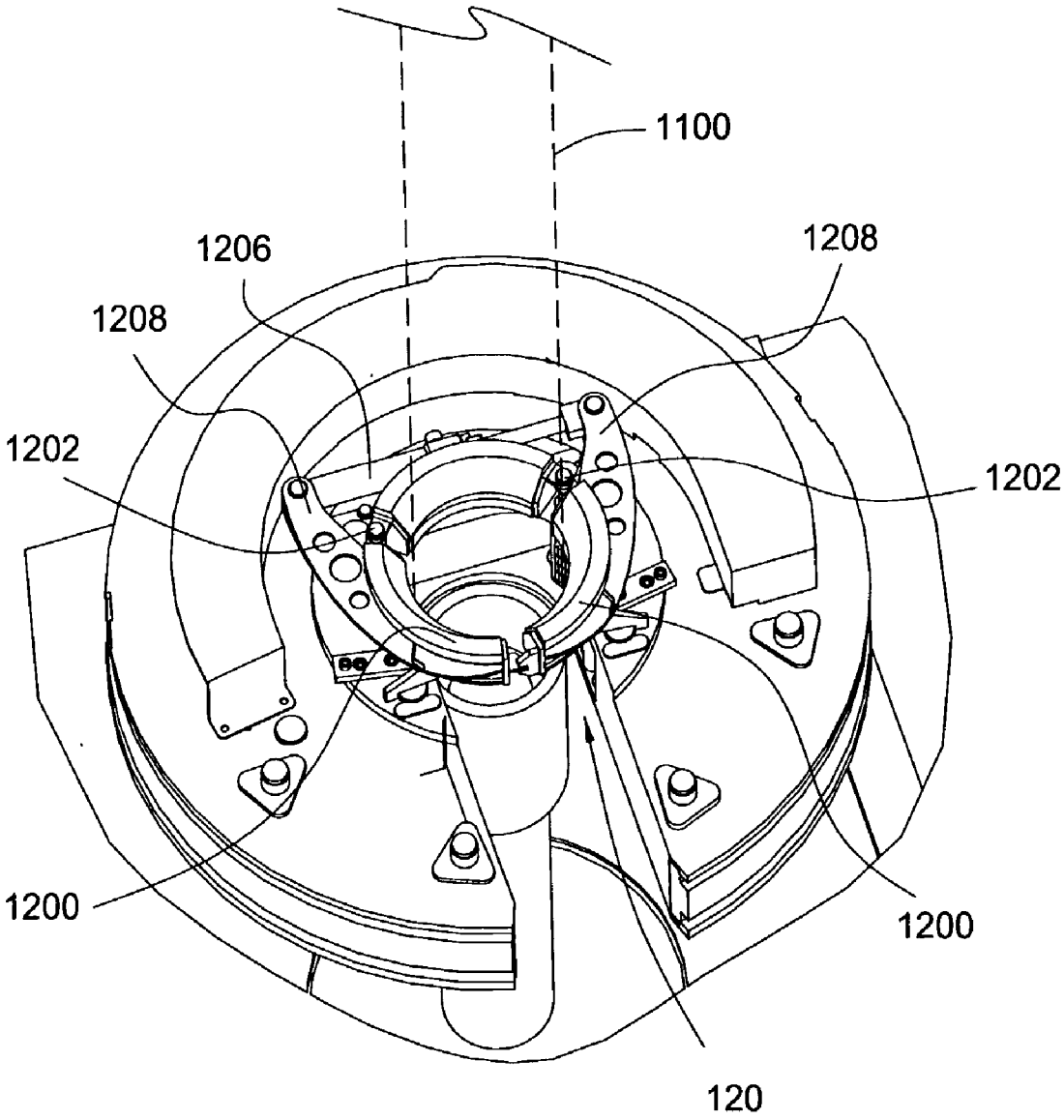
FIG. 13 is a schematic view of the stabbing guide in a closed position around the next strand of tubular.

FIG. 13 shows the stabbing guide 120 in a closed position as it would appear with the second tubular 1100 in position above tubular 105. In the closed position, the actuating means 1206 moves the two semi-circular segments 1200 inward along the rotational axis of the hinges 1202 toward the center portion of the stabbing guide 120. Therefore, the semi-circular segments 1200 and 1204 create a substantially circular inside diameter for at least partially encircling the tubular 1100. The smallest inside diameter formed by the closed stabbing guide 120 is slightly larger than the outside diameter of the tubular 1100 being guided. In this manner, the stabbing guide 120 permits vertical movement of the tubular 1100 while in the closed position but substantially inhibits horizontal movement. Therefore, a pin coupling (not shown) of tubular 1100 is guided into the box coupling of tubular 105 when the stabbing guide 120 is in the closed position.

Figure 14:
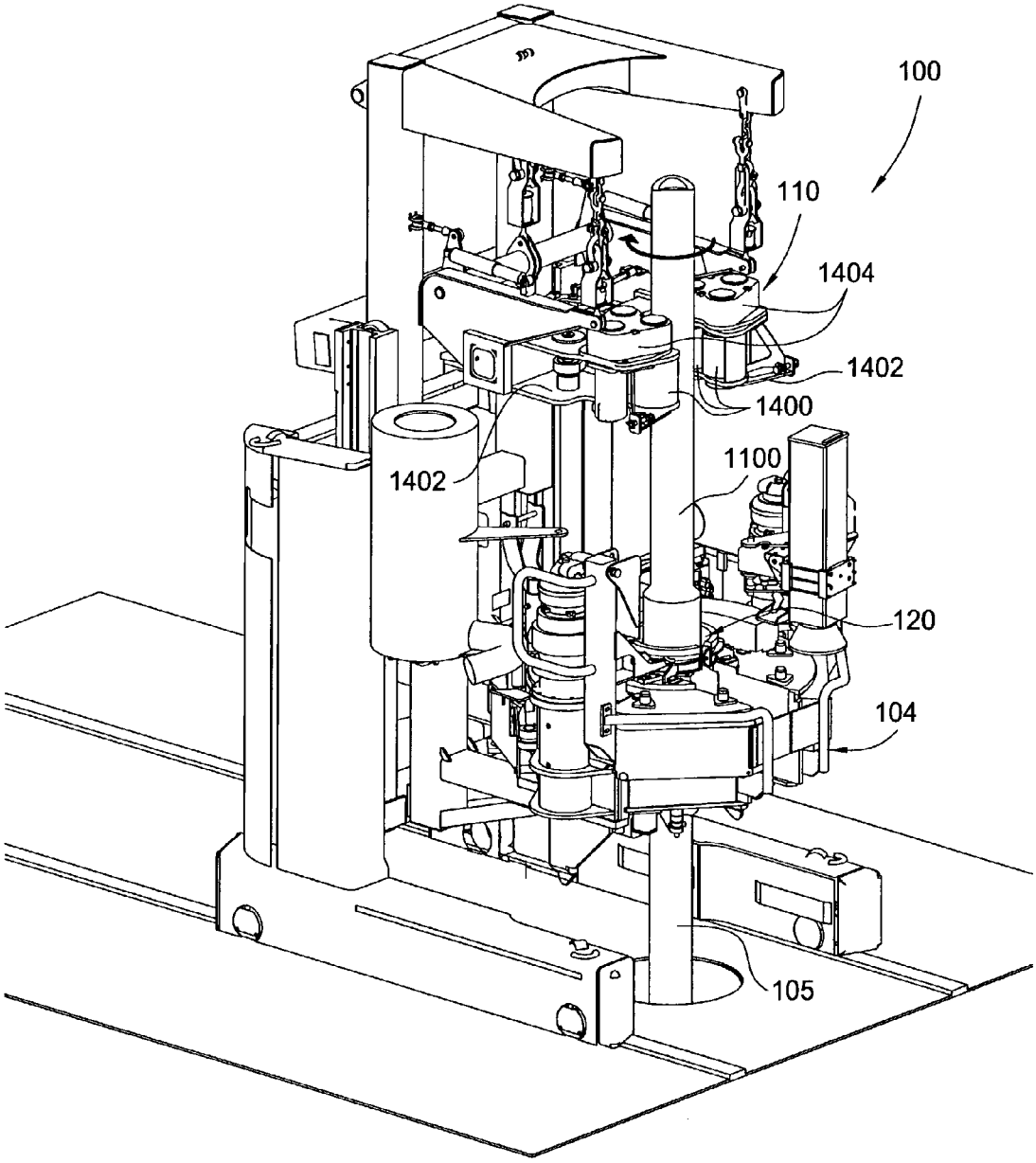
FIG. 14 is a view of an embodiment of the invention spinning the next strand of tubular into connection with the tubular in the well.

FIG. 14 shows the spinner 110 rotating the pin coupling of tubular 1100 into the box coupling 108 of tubular 105. The spinner 110 consists of a plurality of motorized rollers 1400 positioned on movable arms 1402. At a predetermined time, the arms 1402 move horizontally inward toward one another. In this manner, the plurality of rollers 1400 contact an outside surface of tubular 1100. Again, the spinner 110 is aligned around the tubular 1100 due to its alignment with the wrenching assembly 104. Rotating the rollers 1400 by activating motors 1404 therefore spins the tubular 1100. Tubulars 1100 and 105 are properly guided into connection due to the closed stabbing guide 120.

Figure 15:
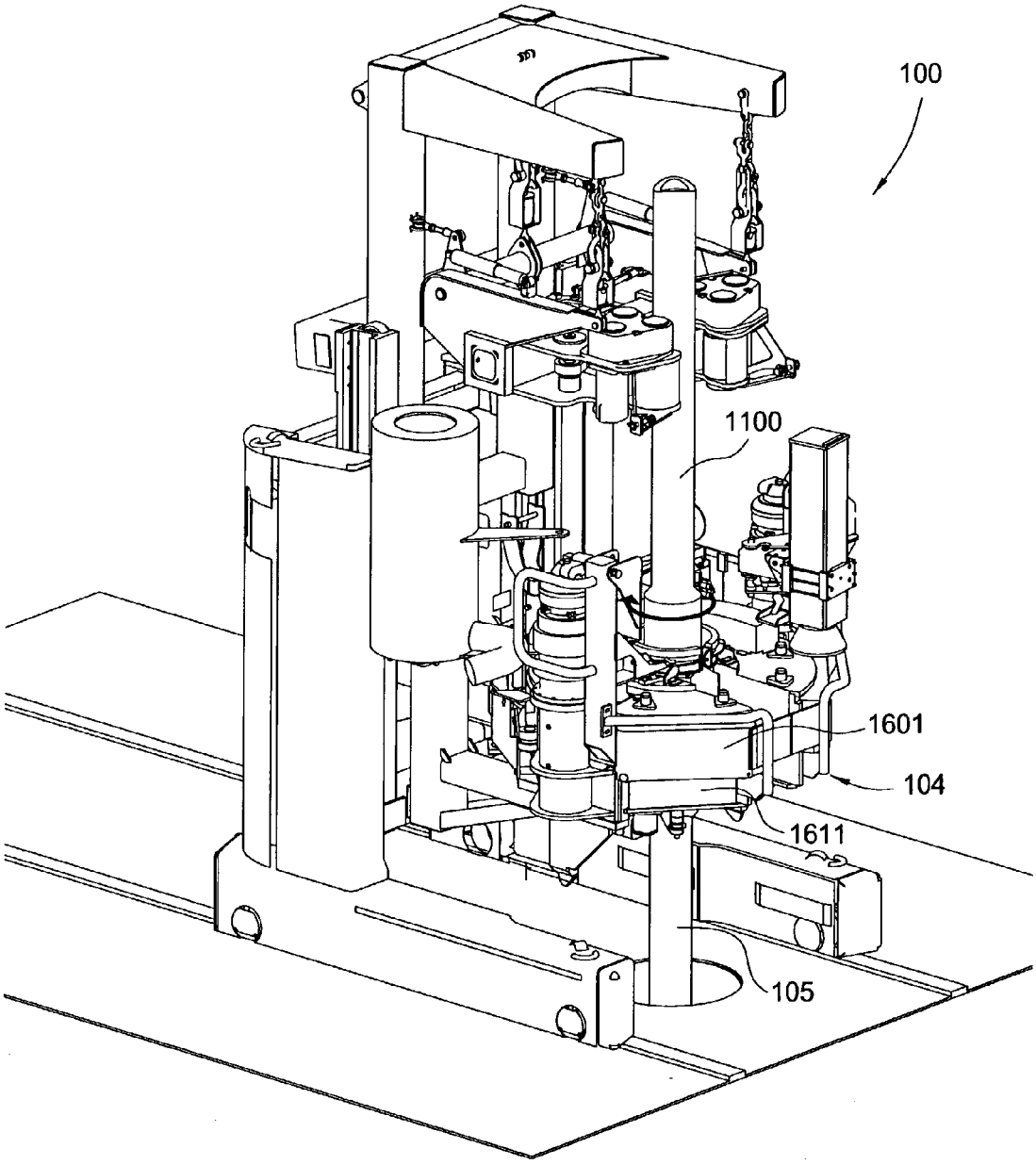
FIG. 15 is a view of an embodiment of the invention wrenching the next strand of tubular into connection with the tubular in the well.

FIG. 15 shows the wrenching assembly 104 applying the required torque to the connection between tubular 1100 and tubular 105. In operation, a wrenching tong 1601 grips the tubular 1100 and applies torque in a direction that tightens the connection. The back-up tong 1611 that had gripped tubular 105 in a previous step continues to maintain a grip on tubular 105 during the process of applying torque to the connection.

Figure 16:
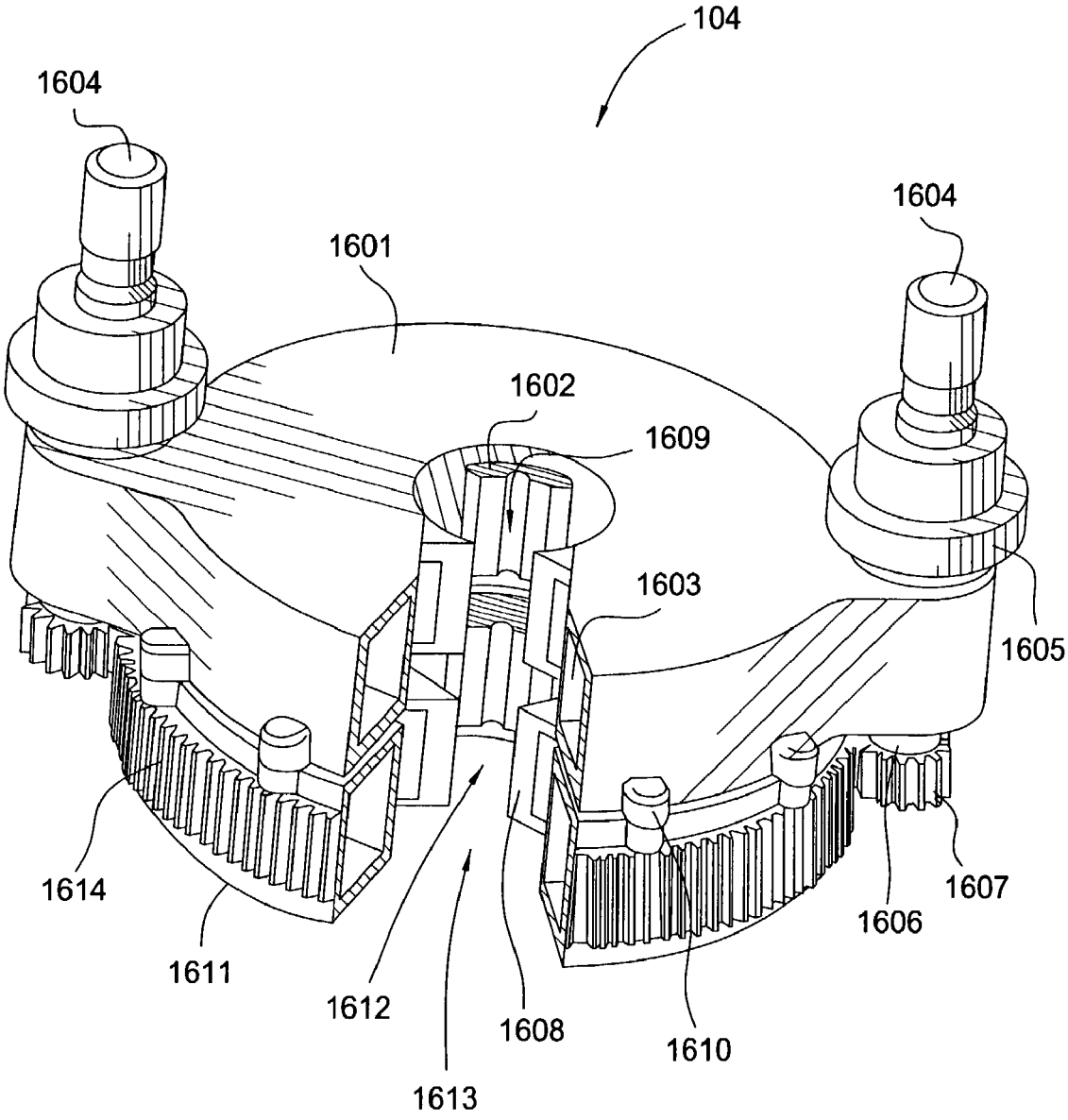
FIG. 16 is a schematic view of an arrangement of a wrenching tong and a back-up tong.

FIG. 16 illustrates an embodiment of the wrenching assembly 104 consisting of the wrenching tong 1601 and back-up tong 1611. The wrenching tong 1601 is generally in the form of a disc with an opening 1602 through the center thereof for receiving the tubular 1100 (shown in FIG. 15), and a recess 1603 cut from the edge to the opening 1602 at the center. The wrenching tong 1601 is provided with two pinion drives 1604 arranged opposite each other at the periphery of the disc 1601, equally spaced either side of the recess 1603. Each pinion drive 1604 comprises a drive motor 1605, drive shaft 1606, and pinion 1607 attached to the drive shaft 1606. The back-up tong 1611 is located beneath the wrenching tong 1601. The back-up tong 1611 is generally in the form of a disc with similar dimensions to the wrenching tong 1601. The back-up tong 1611 is also provided with an opening 1612 through the center and a recess 1613 from the edge to the opening at the center for receiving the tubular 105 (shown in FIG. 15). The opening 1612 and recess 1613 correspond to the opening 1602 and recess 1603 of the wrenching tong 1601 when the back-up tong 1611 and the wrenching tong 1601 are correctly aligned. A plurality of guide rollers 1610 or other guide elements are spaced around the edge of the wrenching tong 1601 in order to maintain the alignment of the wrenching tong 1601 with the back-up tong 1611. A gear 1614 is provided around the periphery of the back-up tong 1611, broken by the recess 1613. The gear 1614 meshes with the pinions 1607 attached to the motors 1605 on the wrenching tong 1601, so that when the drive motors 1605 drive the drive shafts 1606 and pinion 1607, the wrenching tong 1601 rotates relative to the back-up tong 1611. The recess 1613 of the back-up tong 1611 limits the angle of rotation. Roller bearings (not shown) separate the wrenching tong 1601 and the back-up tong 1611. During one wrenching cycle in FIG. 15, the stands will move axially relative to one another as the connection is tightened. The wrenching tong 1601 must follow the axial movement of the top stand during one wrenching cycle. This axial travel length depends on the pitch of the thread.

Figure 17:
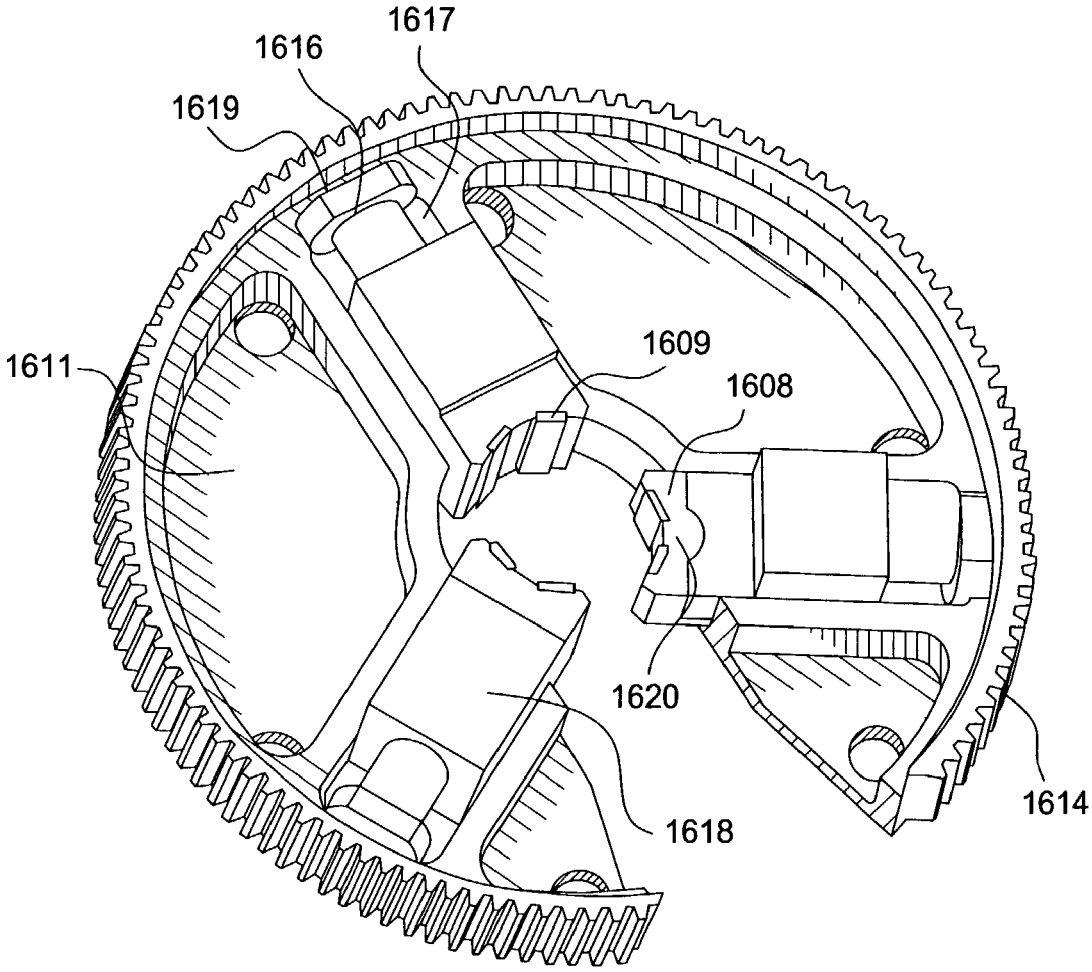
FIG. 17 is a cutaway view of the back-up tong of FIG. 16.

FIG. 17 shows an embodiment of a clamping mechanism of the back-up tong 1611. Three clamping jaws 1608 equipped with dies 1609 are located inside each of the wrenching tong 1601 and back-up tong 1611. These are hydraulically driven for clamping the tubular stand in place in the center of the wrenching tong 1601. Three hydraulic pistons 1616, comprising piston rods 1617 and chambers 1618, are located inside the casing of the back-up tong 1611. Each piston rod 1617 has an end 1619 that is secured to the outside edge of the back-up tong 1611. At the other end of the piston 1616, the jaw 1608 containing two dies 1609 with teeth (not shown) is fixed to the chamber 1618 by a spherical bearing 1620. With the arrangement shown, three jaws 1608 and six dies 1609 at the joint clamp each tubular stand. The spherical bearings 1620 enable the jaws 1608 and dies 1609 to match the tubular surfaces closely, resulting in a low penetration depth of the teeth of the dies 1609 into the tubular surface, and thus prolonging the life of the tubular. The wrenching tong 1601 has a similar clamping jaw design.

After completion of the wrenching process shown in FIG. 15, the tongs of the wrenching assembly 104 release the tubulars and the pipe joining system 100 has completed adding a single additional tubular to the tubular string. Therefore, the process can be repeated in order to add as many additional tubulars as necessary. On the other hand, the pipe joining system 100 can be returned to the standby position in order to complete other operations over the center of the well.

The break out operation of a tubular section during the removal of a tubular string from the wellbore can be accomplished with the pipe joining system 100 by substantially reversing the procedure previously described for assembling a tubular string. Initially, the support frame 102 moves from the standby position of FIG. 1 to the ready position illustrated by FIG. 2. The positioning tool shown in FIG. 3 through FIG. 7 vertically and horizontally aligns the tubular joint in the wrenching assembly. Next, the tongs of the wrenching assembly described in FIG. 16 through FIG. 17 grip the top and bottom tubulars 1100 and 105 shown in FIG. 15 and break the connection between the two tubulars. The wrenching tong 1601 then releases tubulars 1100 and 105.

Figure 18:
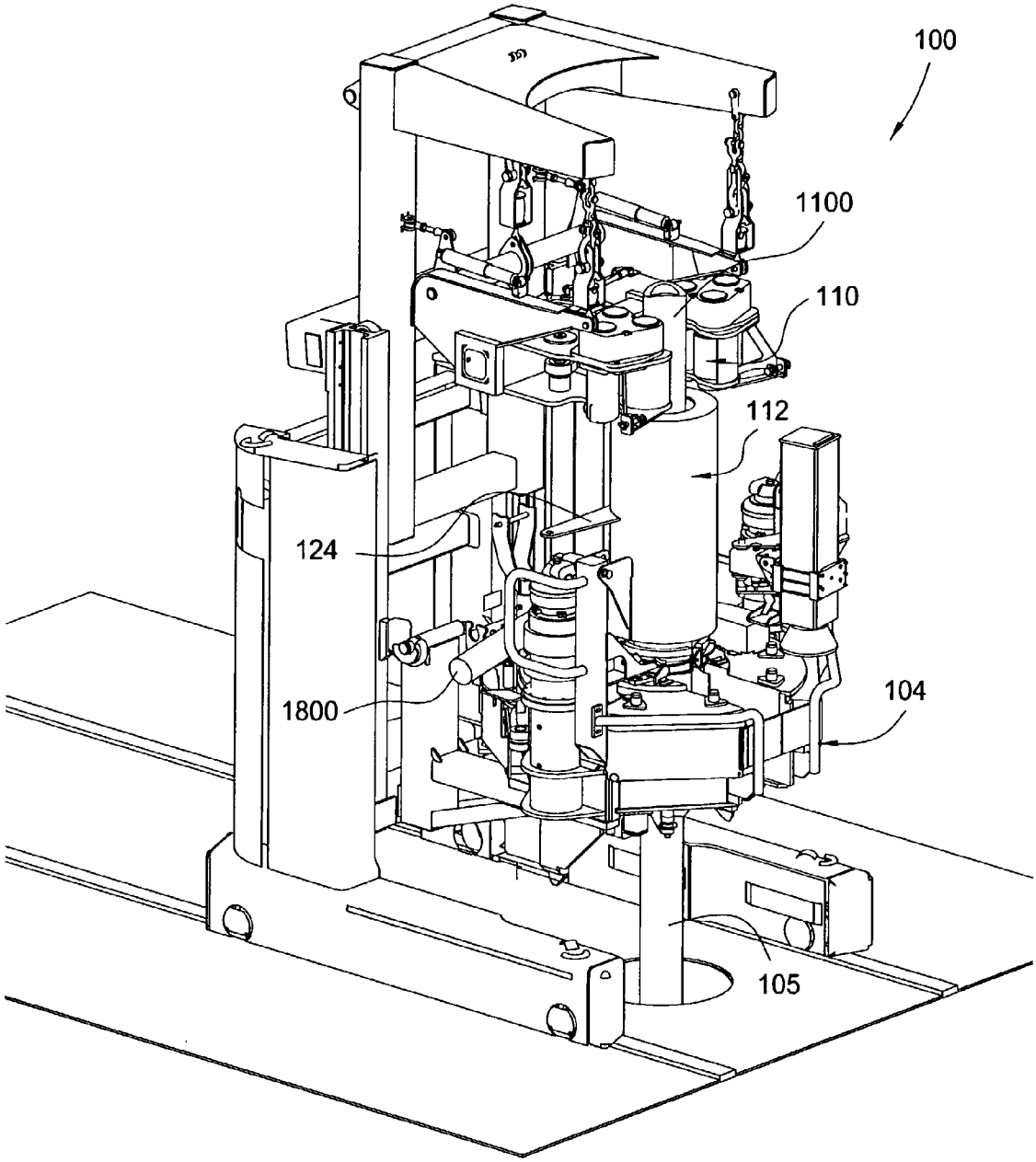
FIG. 18 is a view of an embodiment of the invention with a mud bucket positioned around the connection being spun apart.

FIG. 18 shows the next step in breaking the connection with the mud bucket 112 moved from its standby position to a center position and the spinner 110 spinning apart the connection. The housing forming the mud bucket 112 consists of two cylindrical halves connected by a hinge (not shown) along the mud bucket's vertical axis. The movable arm 124 attaches the mud bucket 112 to the support frame 102. An actuating means (not shown) provides the force necessary to move the arm 124 and the attached mud bucket 112 from the standby position to the center position. As the mud bucket 112 moves from the standby position to the center position, an actuating means (not shown) opens the mud bucket 112 along the hinged axis. In order to accommodate the mud bucket 112 in the center position, the wrenching assembly 104 moves to its lowest position on the support frame 102 and the spinner 110 moves to its highest position. Since the tubulars 105 and 1100 are already centered in the pipe joining system 100, no further alignment of the mud bucket 112 is necessary. After the mud bucket 112 is positioned in the center position, the actuating means (not shown) closes the mud bucket 112 around the joint formed by tubulars 1100 and 105 such that an area directly above and below the joint is covered. Seals (not shown) along the edges of the two cylindrical halves of the mud bucket 112 form a fluid tight seal when the mud bucket 112 is closed. In addition, a seal (not shown) on the bottom of the mud bucket 112 forms a fluid seal between the outside diameter of tubular 105 and the mud bucket 112. Design of this seal accommodates tubulars with varying sizes of outside diameters. An annular area between the outside diameter of the tubulars 1100 and 105 and the inside diameter of the mud bucket 112 collects the mud released when the spinner 110 rotates the pin coupling of tubular 1100 out of the box coupling of tubular 105. A hose (not shown) attached to an outlet 1800 at a lower portion of the mud bucket 112 returns the recaptured mud to a mud pit (not shown). This combination of mud bucket 112 and spinner 110 facilitates breaking tubular connections with special thread profiles such as Hydril Wedge thread.

After completion of the spinning process shown in FIG. 18, the mud bucket 112 returns to the standby position. Therefore, the pipe joining system 100 has completed breaking out a single tubular from the tubular string. The process can be repeated in order to remove as many tubulars as necessary. On the other hand, the pipe joining system 100 can be returned to the standby position in order to complete other operations over the center of the well.

Figure 19:
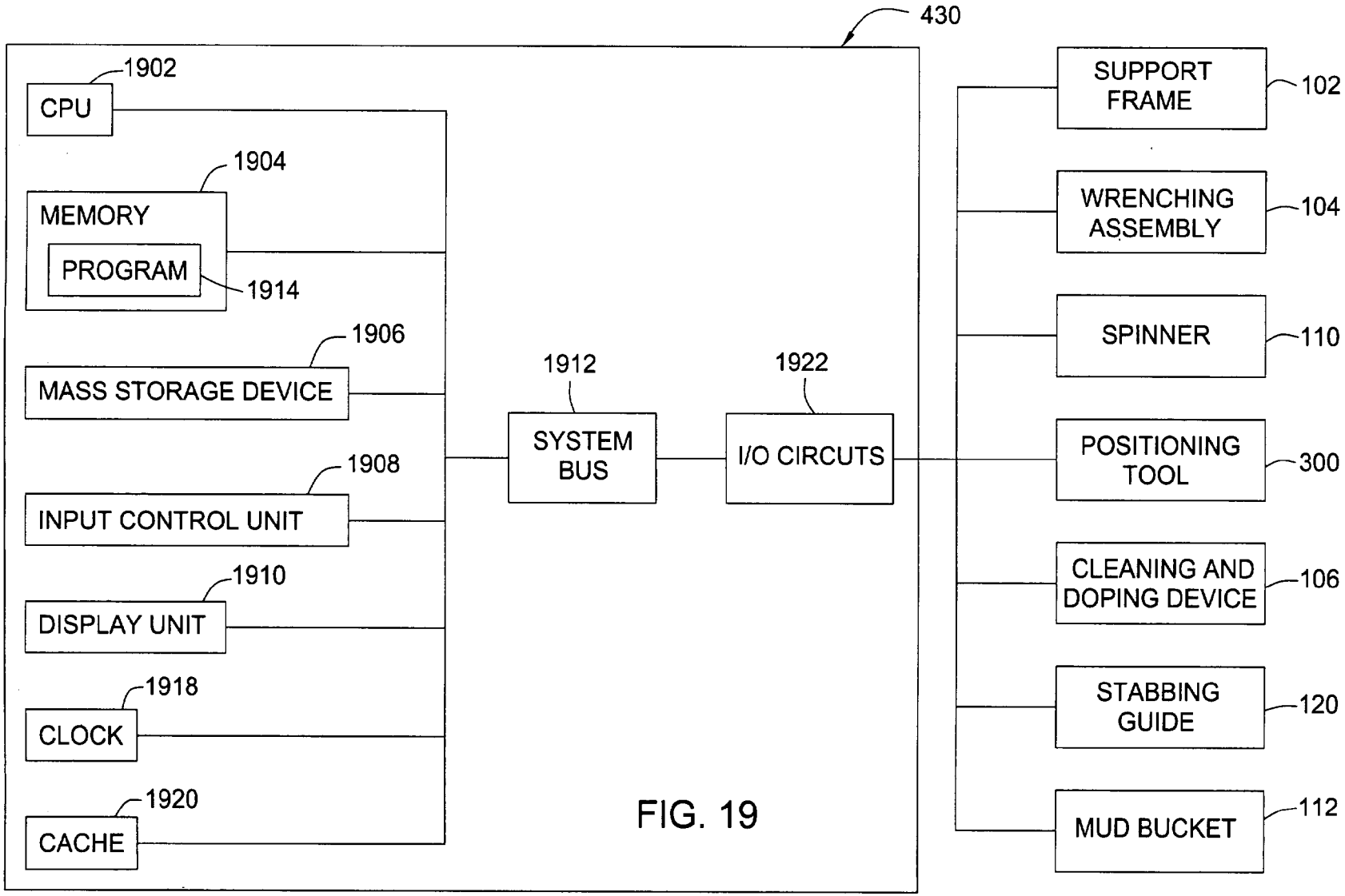
FIG. 19 is a block diagram of a processing system for remotely controlling the embodiment shown in FIG. 1 with a control system.

As described above, the pipe joining system 100 can be implemented in a system that is controlled by a processor based control system such as the processing system shown in FIG. 19. FIG. 19 block diagrams the control system 430 that includes a programmable central processing unit (CPU) 1902 that is operable with a memory 1904, a mass storage device 1906, an input control unit 1908, and a display unit 1910. The system controller further includes well-known support circuits such as power supplies (not shown), clocks 1918, cache 1920, input/output (I/O) circuits 1922, and the like. The control system 430 also includes hardware for monitoring the pipe joining system 100 parameters. All of the above elements are coupled to a control system bus 1912. The memory 1904 contains instructions that the CPU 1902 executes to facilitate the performance of the pipe joining system 100. The instructions in the memory 1904 are in the form of program code such as a program 1914 that implements the method of the present invention. The program code may conform to any one of a number of different programming languages. For example, the program code can be written in C, C++, BASIC, Pascal, or a number of other languages. The mass storage device 1906 stores data and instructions and retrieves data and program code instructions from a processor readable storage medium, such as optical disk, magnetic disk, or magnetic tape. For example, the mass storage device 1906 can be a hard disk drive, floppy disk drive, tape drive, or optical disk drive. The mass storage device 1906 stores and retrieves the instructions in response to directions that it receives from the CPU 1902. The processor unit 1902 for operating the control system 430 employs data and program code instructions that are stored and retrieved by the mass storage device 1906. The data and program code instructions are first retrieved by the mass storage device 1906 from a medium and then transferred to the memory 1904 for use by the CPU 1902. The input control unit 1908 couples a data input device, such as a keyboard, mouse, or light pen, to the processor unit 1902 to provide for the receipt of an operator's inputs. The display unit 1910 provides information to the operator in the form of graphical displays and alphanumeric characters under control of the CPU 1902. The control system bus 1912 provides for the transfer of data and control signals between all of the devices that are coupled to the control system bus 1912. Although the control system bus 1912 is displayed as a single bus that directly connects the devices in the CPU 1902, the control system bus 1912 can also be a collection of busses. For example, the display unit 1910, input control unit 1908 and mass storage device 1906 can be coupled to an input-output peripheral bus, while the CPU 1902 and memory 1904 are coupled to a local processor bus. The local processor bus and input-output peripheral bus are coupled together to form the control system bus 1912. The control system 430 is remotely coupled to the components of the pipe joining system 100 in accordance with the present invention via the system bus 1912 and the I/O circuits 1922. These components include the following: the support frame 102, the wrenching assembly 104, the spinner 110, the positioning tool 300, the cleaning and doping device 106, the stabbing guide 120, and the mud bucket 112. The control system 430 provides signals to the components of the pipe joining system 100 that cause these components to perform the operations for making up and breaking out tubulars. Although the invention is described herein as being implemented in software and executed upon a general-purpose computer, those skilled in the art will realize that the invention could be implemented using hardware such as an application specific integrated circuit (ASIC) or other hardware circuitry. As such, it should be understood that the invention can be implemented, in whole or in part, in software, hardware, or both.

Making and breaking connections between tubulars can be accomplished in a method that utilizes a pipe joining system as described above. In order to make a connection between two tubulars, the pipe joining system is disposed on a rig floor and located proximate a tubular that extends from the wellbore so that the tubular is in an operating space of the pipe joining system. The method includes positioning the pipe joining system around the tubular with a positioning tool operatively connected to a wrenching assembly, preparing the threads of the tubular with a cleaning and doping device operatively connected to the pipe joining system, placing a second tubular above and in substantial axial alignment with the tubular extending from the wellbore, maintaining the alignment with a stabbing guide operatively connected to the pipe joining system, rotating the second tubular with a spinner operatively connected to the pipe joining system, and wrenching the connection to the desired torque with the wrenching assembly that is operatively connected to the pipe joining system. Utilizing a similar method in reverse order breaks out tubulars from a well. During break out of tubulars, positioning a mud bucket operatively connected to the pipe joining system around the joint being spun apart contains the mud that is released when the connection is broken. An operator remotely controls from a safe distance any or all of these steps in the make up and break out method described by using a central control system.

While the foregoing is directed to embodiments of the present invention, other and further embodiments of the invention may be devised without departing from the basic scope thereof, and the scope thereof is determined by the claims that follow.

The invention claimed is:

1. An apparatus for making and breaking joints of wellbore tubulars, comprising:

a support frame;

a tong assembly operatively connected to the support frame; and a stabbing guide having a plurality of semi-circular segments with a tapered inside diameter and an actuating device capable of moving the plurality of semi-circular segments independently from the tong assembly between an open position and a closed position that at least partially encircles a tubular member.

2. The apparatus of claim 1 wherein the plurality of semi-circular segments are connected by hinges.

3. The apparatus of claim 1 wherein the stabbing guide in the closed position axially aligns a connection between two tubulars.

4. The apparatus of claim 1, wherein the tong assembly is a wrench.

5. The apparatus of claim 1, further comprising a control system for remotely controlling the movements of the support frame and the tong assembly.

6. The apparatus of claim 1, further comprising a mud bucket operatively connected to the support frame.

7. The apparatus of claim 1, further comprising a cleaning and doping device operatively connected to the support frame.

8. The apparatus of claim 1, further comprising:

a cleaning and doping device operatively connected to the support frame; and a mud bucket operatively connected to the support frame.

9. The apparatus of claim 1 further comprising:

a mud bucket operatively connected to the support frame;

a cleaning and doping device operatively connected to the support frame;

a spinner operatively connected to the support frame;

a positioning tool; and a control system for remotely controlling the tong assembly, the positioning tool, and the spinner.

10. An apparatus for making and breaking joints of wellbore tubulars, comprising:

a support frame;

a tong assembly operatively connected to the support frame;

a stabbing guide; and a positioning tool for detecting a center position and a vertical position of a tubular joint of a tubular member.

11. The apparatus of claim 10, further comprising a mud bucket operatively connected to the support frame.

12. The apparatus of claim 10, further comprising a cleaning and doping device operatively connected to the support frame.

13. The apparatus of claim 10, further comprising:

a cleaning and doping device operatively connected to the support frame; and a mud bucket operatively connected to the support frame.

14. An apparatus for making and breaking joints of wellbore tubulars, comprising:

a support frame;

a tong assembly operatively connected to the support frame; and a mud bucket operatively connected to the support frame; and a positioning tool for detecting a center position and a vertical position of a tubular joint of a tubular member.

15. The apparatus of claim 14, further comprising a control system for remotely controlling the movements of the tong assembly and the mud bucket.

16. The apparatus of claim 14, wherein the tong assembly is a wrench.

17. The apparatus of claim 14, wherein the tong assembly is a spinner.

18. The apparatus of claim 17, further including a wrenching assembly operatively connected to the support frame.

19. A method for connecting two tubulars, comprising:

disposing a pipe joining system on a rig floor, the pipe joining system being remotely operable and having a tong assembly and tubular alignment member operatively connected thereto, wherein the tubular alignment member includes a plurality of semi-circular segments with a tapered inside diameter and an actuating device capable of moving the plurality of semi-circular segments independently of the tong assembly between open and closed positions;

locating the pipe joining system proximate a first tubular, wherein the first tubular is positioned within an operating space of the pipe joining system;

placing a second tubular above and in substantial axial alignment with the first tubular, such alignment being maintained by closing the tubular alignment member with the actuating device to at least partially encircle the second tubular;

engaging the first tubular and the second tubular with the tong assembly; and operating the tong assembly to engage a thread of the first tubular with a mating thread of the second tubular.

20. The method of clam 19, further comprising activating a cleaning and doping device operatively connected to the pipe joining system.

21. The method of claim 19, further comprising controlling movements of the pipe joining system with a control system.

22. The method of claim 19, further comprising detecting a center position and a vertical position of the first tubular with a positioning tool.

23. The method of claim 19, further comprising:

detecting a center position and a vertical position of the first tubular with a positioning tool; and activating a cleaning and doping device operatively connected to the pipe joining system.

24. The method of claim 19, wherein the tong assembly is a wrench.

25. The method of claim 19, wherein the tong assembly is a spinner.

26. The method of clam 25, further comprising activating a wrenching assembly operatively connected to the pipe joining system to torque a connection between the first tubular and the second tubular.

27. The method of claim 26, further comprising activating a cleaning and doping device operatively connected to the pipe joining system.

28. A method for disconnecting two tubulars, comprising:

disposing a pipe joining system on a rig floor, the pipe joining system being remotely operable and having a positioning tool and mud bucket operatively connected thereto;

locating the pipe joining system proximate a connection between a first tubular and a second tubular, wherein the connection is positioned within an operating space of the pipe joining system;

detecting a center position and a vertical position of the joint between the first tubular and the second tubular with the positioning tool;

moving the mud bucket from a first position to a second position; and separating a thread of the first tubular from a mating thread of the second tubular.

29. The method of claim 28, further comprising controlling movements of the pipe joining system with a control system.

30. The method of claim 28, further comprising breaking the connection with a wrenching assembly operatively connected to the support frame.

31. The method of claim 28, wherein moving a mud bucket from a first position to a second position includes opening the mud bucket along a hinge on a vertical axis of the mud bucket and closing the mud bucket in the second position around a joint between the first tubular and the second tubular.

32. The method of claim 28, wherein moving a mud bucket from a first position to a second position includes opening the mud bucket along a hinge on a vertical axis of the mud bucket and closing the mud bucket in the second position around a joint between the first tubular and the second tubular.

33. An apparatus for making and breaking joints of wellbore tubulars, comprising;

a support frame;

a tong assembly operatively connected to the support frame, the tong assembly having a first tong configured to grip a first tubular member on a first side of a joint and a second tong configured to grip a second tubular member on a second side of the joint;

a spinner operatively connected to the support frame and spaced from the tong assembly; and at least three components selected from the group consisting of:

a stabbing guide;

a mud bucket operatively connected to the support frame;

a cleaning and doping device operatively connected to the support frame; and a positioning tool.

34. The apparatus of claim 33, further comprising a control system for remotely controlling at least one of the components selected from the group consisting of:

the tong assembly;

the stabbing guide;

the mud bucket;

the cleaning and doping device;

the spinner; and the positioning tool.

* * * * *